US008789331B2

(12) United States Patent
Bol

(10) Patent No.: US 8,789,331 B2
(45) Date of Patent: Jul. 29, 2014

(54) SYSTEM AND METHOD FOR COVERING A SURFACE OF A WALL

(75) Inventor: Rientz Willem Bol, Hendrik-Ido-Ambacht (NL)

(73) Assignee: Bolidt Maatschappij tot Exploitatie van Kunststoffen en Bouwwerken B.V., Hendrik-Ido-Ambacht (NL)

( * ) Notice: Subject to any disclaimer, the term of this patent is extended or adjusted under 35 U.S.C. 154(b) by 0 days.

(21) Appl. No.: 13/440,679

(22) Filed: Apr. 5, 2012

(65) Prior Publication Data

US 2012/0255254 A1 Oct. 11, 2012

(30) Foreign Application Priority Data

Apr. 6, 2011 (NL) ..... 2006559

(51) Int. Cl.
*E04B 2/00* (2006.01)
*E04B 5/00* (2006.01)
*E04B 9/00* (2006.01)

(52) U.S. Cl.
USPC ..... 52/506.05; 52/489.1; 52/650.3; 52/747.1

(58) Field of Classification Search
USPC ..... 52/650.3, 489.1, 506.05, 509, 512, 263, 52/126.6, 655.1, 220.1, 745.21, 747.1, 508
See application file for complete search history.

(56) References Cited

U.S. PATENT DOCUMENTS

| | | | | |
|---|---|---|---|---|
| 2,956,652 | A * | 10/1960 | Liskey, Jr. | 52/126.6 |
| 3,130,470 | A * | 4/1964 | Bowden et al. | 249/192 |
| 5,613,339 | A | 3/1997 | Pollock | |
| 5,735,097 | A | 4/1998 | Cheyne | |
| 7,360,343 | B1 * | 4/2008 | Spransy et al. | 52/263 |
| 2005/0284040 | A1 * | 12/2005 | Hashimoto et al. | 52/126.1 |
| 2007/0186498 | A1 * | 8/2007 | Buzon | 52/263 |
| 2012/0131862 | A1 * | 5/2012 | Hashimoto et al. | 52/126.6 |

FOREIGN PATENT DOCUMENTS

| | | |
|---|---|---|
| DE | 10 2006 043478 A1 | 4/2008 |
| WO | WO 2007/073028 A1 | 6/2007 |

* cited by examiner

*Primary Examiner* — Brian Glessner
*Assistant Examiner* — Brian D Mattei
(74) *Attorney, Agent, or Firm* — Daniel G. Stoddard; Bret E. Field; Bozicevic, Field & Francis, LLP

(57) ABSTRACT

The present invention relates to a system and a method for covering a surface of a wall, preferably the surface of a wall of a ship, more preferably the surface of the deck of a ship.
The system according to the invention comprises:
- a number of first wall-covering elements;
- two mounting assemblies, each comprising a second wall-covering element and a connecting assembly for releasable connection of the second wall-covering element to the surface of the wall for covering; and
- a number of first coupling elements for coupling the first wall-covering elements to the mounting assemblies.

33 Claims, 12 Drawing Sheets

SYSTEM AND METHOD FOR COVERING A SURFACE OF A WALL

The present invention relates to a system and a method for covering a surface of a wall, preferably the surface of a wall of a ship, more preferably the surface of the deck of a ship.

Such systems are known. Particularly known is a system wherein a teak covering is arranged on relatively small deck surfaces of a ship, such as a deck surface of a balcony of a cabin on a cruise ship. Such a teak covering has the drawback that the costs of arranging and maintenance thereof are considerable in terms of time and money. An alternative system which partially obviates the stated drawback of a teak covering is a system wherein a plastic covering is arranged on the deck surface by pouring a layer of plastic material in liquid form onto the deck surface for covering and, after curing thereof, treating this layer of plastic material such that it has the appearance of a teak covering. Although this alternative system partially obviates the stated drawback of a teak covering, the costs of arranging and maintenance thereof are still considerable in terms of time and money.

The present invention has for its object, among others, to further obviate the stated drawback of a teak covering.

The system according to the invention comprises:

- a number of first wall-covering elements;
- two mounting assemblies, each comprising a second wall-covering element and a connecting assembly for releasable connection of the second wall-covering element to the surface of the wall for covering; and
- a number of first coupling elements for coupling the first wall-covering elements to the mounting assemblies.

This system makes it possible, using only two mounting assemblies, to connect a number of first wall-covering elements simultaneously to the surface of the wall for covering. This simplifies covering of the surface of the wall for covering with wall-covering elements as well as detaching of the wall-covering elements for the purpose of replacement thereof. The measure that the mounting assemblies comprise a second wall-covering element makes it possible here for the connecting assemblies and the first coupling elements to be largely covered by means of the second wall-covering elements, so that the connecting assemblies and the coupling elements need not be situated under the first wall-covering elements so as to be less visible to the user of the wall for covering, but can be positioned adjacently of the first wall-covering elements. This has the advantage that the connecting assemblies and the first coupling elements are for the greater part invisible to the user, while the connecting assemblies and the first coupling elements are easily accessible, for instance when maintenance of components of the system is necessary, such as the replacement of a number of the first wall-covering elements, by removing only the two second wall-covering elements. The system according to the invention is thus preferably configured such that

- the first wall-covering elements can be mounted via the first coupling elements on the surface for covering by means of the mounting assemblies;
- the second wall-covering elements at least partially cover the connecting assemblies and the first coupling elements after connection; and
- the upper surface of the wall covering realized by means of the system comprises the upper surface of the first wall-covering elements and the upper surface of the second wall-covering elements.

Just as in the system with the poured plastic covering, the wall-covering elements can be made of plastic material which has the appearance of a teak covering element. The wall-covering elements of the system according to the invention can be manufactured under optimum conditions at a factory location and subsequently transported to a ship and there arranged on a surface of a wall for covering of this ship. It is favourable here to already couple the first wall-covering elements to the mounting assemblies by means of the coupling elements at the factory location, so that a prefabricated wall covering results which can be transported to the location of use and there arranged directly on the surface of a wall for covering. This causes less disruption to other work operations being carried out at the location of use.

In a favourable embodiment of the system according to the invention the first wall-covering elements and the second wall-covering elements are elongate elements, and the first wall-covering elements, the mounting assemblies and the first coupling elements are embodied such that the first wall-covering elements can be coupled to the mounting assemblies by means of the first coupling elements such that the second wall elements each extend along a transverse side of the first wall-covering elements.

This embodiment enables exceptionally rapid and simple arrangement or removal of a wall covering with the system according to the invention on a relatively large surface of a wall for covering.

In a favourable embodiment hereof a first coupling element comprises:

- a number of first engaging members which can be placed into engagement with one of the first wall-covering elements on a transverse side of this first wall-covering element; and
- a number of second engaging members which can be placed into engagement with one of the second wall-covering elements on a longitudinal side of this second wall-covering element;

so that the first wall-covering element is connected via the second wall-covering element to the connecting assembly of the mounting assembly.

These measures make it possible for the second wall-covering elements, with first wall-covering elements coupled thereto, to be easily arranged or removed in the coupled state from the surface of the wall for covering. This has the advantage that a wall covering formed by means of the system according to the invention can be arranged, removed or replaced in one operation.

In an additional favourable embodiment the mounting assemblies, the first coupling elements and the first wall-covering elements are embodied such that, when the first wall-covering elements have been mounted by means of the mounting assemblies on a surface of a wall for covering, the removal of the first wall-covering elements is blocked as long as the second wall-covering elements are connected via the connecting assemblies to the surface of the wall for covering. This measure makes it possible that the separate first wall-covering elements can be removed only after the two second wall-covering elements have been taken away. This has the advantage that, if the two second wall-covering elements are adequately connected to the surface of the wall for covering, this also guarantees that the first wall-covering elements are adequately connected to the surface of the wall for covering.

In a further favourable embodiment of the system according to the invention, wherein a first wall-covering element is connected via a second wall-covering element to the connecting assembly of a mounting assembly, a first engaging member of a coupling element and a first wall-covering element both comprise a number of engaging surfaces, these engaging surfaces being embodied such that the first wall-covering element and the first engaging member can be placed into form-fitting engagement with each other such that a displacement of the first wall-covering element relative to the engaging member in a direction substantially transversely of the longitudinal direction of the first wall-covering element is prevented, and a second engaging member and a second wall-covering element both comprise a number of engaging surfaces, these engaging surfaces being embodied such that the second wall-covering element and the second engaging member can be placed into form-fitting engagement with each other so that a displacement of the second wall-covering element relative to the engaging member in a direction substantially transversely of the longitudinal direction of the second wall-covering element is prevented. These measures make it possible in a simple and effective manner for a first wall-covering element to be connected via a second wall-covering element to the connecting assembly of a mounting assembly.

In a further favourable embodiment of the system according to the invention, wherein the removal of the first wall-covering elements is blocked as long as the second wall-covering elements are connected via the connecting assemblies to the surface of the wall for covering, the first engaging members and the first wall-covering elements are embodied such that a first engaging member can be placed into an engaged state with the first wall-covering element only in the longitudinal direction of a first wall-covering element and can be moved out of the engaged state with the first wall-covering element only in the longitudinal direction of the first wall-covering element, and the second wall-covering elements comprise an underside which, when the second wall-covering elements have been connected to the surface of a wall for covering, faces toward the surface for covering and an upper side which faces away from the surface of a wall for covering, wherein the second engaging members and the second wall-covering elements are adapted such that moving the second engaging members out of the engaged state with the second wall-covering elements is blocked in a direction from the underside to the upper side of the second wall-covering elements. These measures make it possible in simple and effective manner for removal of the first wall-covering elements to be blocked as long as the second wall-covering elements are connected via the connecting assemblies to the wall for covering.

In a favourable embodiment hereof the first wall-covering elements comprise a cavity extending from a side surface on the transverse side of the first wall-covering elements in the lengthwise direction of the first wall-covering elements, and the first engaging members comprise a protruding part which can be inserted into the cavity of the first wall-covering elements in order to place the first engaging members into the engaged state with the first wall-covering element, wherein the second wall-covering elements comprise a cavity extending from a lower surface on the underside of the second wall-covering elements in the direction of the upper side of the second wall-covering elements, and wherein the second engaging members comprise a protruding part which can be inserted into the cavity of the second wall-covering elements in order to place the second engaging members into the engaged state with the second wall-covering element.

In a further favourable embodiment of the system according to the invention a single first coupling element is adapted to couple at least one of the first wall-covering elements to one of the mounting assemblies.

In a favourable embodiment hereof a single first coupling element is adapted to couple two adjacent first wall-covering elements to one of the mounting assemblies. This measure makes it possible to reduce the number of coupling elements to be used and moreover makes it possible for adjacent first wall-covering elements to abut neatly.

In a further favourable embodiment of the system according to the invention the system also comprises a number of second coupling elements adapted to mutually couple the longitudinal sides of first wall-covering elements oriented parallel to each other and extending in one plane. This measure makes it possible to couple adjacent first wall-covering elements to each other, for instance before the first wall-covering elements are coupled to the mounting assemblies by means of the first coupling elements.

In a favourable embodiment hereof a single second coupling element comprises:

- a number of third engaging members which can be placed into engagement with one of the first wall-covering elements on a longitudinal side thereof; and
- a number of third engaging members which can be placed into engagement with another of the first wall-covering elements on a longitudinal side thereof, wherein a third engaging member and a first wall-covering element both comprise a number of engaging surfaces, these engaging surfaces being embodied such that the first wall-covering element and the third engaging member can be placed into form-fitting engagement with each other such that a displacement of the first wall-covering element relative to the third engaging member in a direction substantially transversely of the longitudinal direction of the first wall-covering element is prevented. These measures enable an effective and simple embodiment of the second coupling elements and the first wall-covering elements.

In a favourable embodiment of the system according to the invention with engaging members, a number of the engaging members comprise a number of snap fingers with an engaging surface on a free end thereof, wherein an engaging member and a wall-covering element to be placed into engagement therewith are embodied such that by bending the snap fingers outward the engaging surface on the free end thereof can be displaced such that the engaging member can be moved in a direction transversely of the longitudinal direction of the wall-covering element into an engaged state with the wall-covering element in which the engaging surface on the free end of the snap fingers is in engagement with an engaging surface of the wall-covering element, and that by bending the snap fingers outward the engaging surface on the free end thereof can be displaced such that the engaging member can be moved in a direction transversely of the longitudinal direction of the wall-covering element out of an engaged state with the second wall-covering element. These measures enable an effective coupling between the engaging members and the wall-covering elements which is moreover easy to realize or to release.

In a further favourable embodiment of the system according to the invention at least one of a first wall-covering element and a second wall-covering element comprises:

- an upper wall with an upper surface which, when the wall-covering element has been arranged on a surface of a wall for covering, faces away from the surface for covering, and a lower surface;
- two first side walls extending on both longitudinal sides of the upper wall from the lower surface and substantially transversely of the upper surface;
- two lower walls extending on the longitudinal sides of the first side walls remote from the upper wall, substantially transversely of the side walls and in the same plane.

Such a wall-covering element enables a simple and effective coupling of the wall-covering elements to engaging members along the longitudinal sides and transverse sides.

This makes it for instance possible that the first and second wall-covering elements can have the same cross-section, and both can for instance be formed from the same elongate profile beam. This has the advantage that the costs of the system according to the invention can be lower than if the first and second wall-covering elements were formed from different elements. Because of the lower walls the coupling elements moreover need not engage on the upper surface of the wall-covering elements, so that the coupling elements can remain largely concealed from the user. The hollow space defined by the upper wall and the side walls in use under the upper wall also makes it possible for the wall-covering elements to be given a form which is relatively lightweight and has relative bending stiffness. This hollow space also makes it possible for the surface of the wall for covering to be insulated from the upper surface of the wall-covering elements by means of an air layer, with the advantage that the surface of the wall for covering is heated less as a result of solar radiation. The hollow space also makes it possible to arrange additional elements under the upper surface of the wall elements, such as the connecting assemblies in the case of the second wall-covering elements, or for instance a power supply for lighting, conduits for a cooling liquid, conduits for water and the like.

In a favourable embodiment hereof the ends of the lower walls remote from the first side walls are directed toward each other. This measure makes it possible for the coupling elements to partially engage on the wall elements in the hollow space under the upper surface of the wall elements, with the advantage that the coupling elements are less visible to the user.

In a further favourable embodiment hereof the wall-covering elements comprise two side walls extending on the longitudinal sides of the lower walls remote from the first side walls substantially transversely of the lower walls in parallel planes in the direction of the lower surface of the upper wall, wherein the ends of the second side walls remote from the lower walls are situated at a distance from the lower surface of the upper wall. These measures enable a particularly effective form-fitting engagement of the first coupling elements on the transverse side of the wall-covering elements as well as of the second coupling elements on the longitudinal side of the wall-covering elements.

In a favourable embodiment of the system according to the invention with engaging members, a number of the engaging members comprise a number of spring elements, wherein a single spring element comprises a tubular body, and the wall-covering elements to be placed into engagement with the engaging members with spring elements comprise a tubular cavity, wherein the wall of the cavity comprises an opening extending in the lengthwise direction so that the tubular body of the spring elements can be placed in the cavity in order to place the engaging members in the engaged state with the wall-covering elements, wherein in the engaged state the outer surface of the wall of the tubular body is in contact with the inner surface of the cavity so that the spring elements are in form-fitting engagement with the wall-covering elements. These measures enable an effective coupling between the engaging members and the wall-covering elements which is easy to realize or to release. These measures moreover make it possible in exceptionally compact manner to prevent a displacement of an engaging member relative to a wall-covering element in directions transversely of the direction in which the tubular cavity extends. In a particularly favourable embodiment hereof the wall of the tubular body is cut through in the lengthwise direction of the body. This measure enables the tubular body to be deformed in simple manner. This deformation enables simpler placing of the spring element in the tubular cavity.

In an additional favourable embodiment of the system according to the invention the coupling elements comprise a spacer element adapted to hold at a distance from each other two wall-covering elements mutually coupled by means of the coupling element. This measure makes it possible for two adjacent wall-covering elements to be arranged at a fixed distance from each other, for instance a distance which makes it possible for water falling on the wall-covering elements to flow away between the wall-covering elements.

In a further favourable embodiment of the system according to the invention a single connecting assembly comprises:

- a number of first connecting members for placing the connecting assembly into engagement with the surface of the wall for covering; and
- a number of second connecting members for placing the connecting assembly into releasable engagement with a second wall-covering element.

These measures enable a simple and effective embodiment of the connecting assemblies.

In a favourable embodiment hereof the first connecting members are preferably plate-like and adapted for placing thereof into non-releasable engagement with the surface of the wall for covering by means of an adhesive, and the second connecting members preferably comprise a bolt and a nut co-acting therewith, and a number of holes are arranged in a second wall-covering element through which at least one of the bolt and the nut can protrude for the purpose of placing the second wall-covering element into releasable engagement with the connecting assembly. These measures particularly make it possible with the system according to the invention to first form a wall covering by coupling a number of first wall-covering elements to the two mounting assemblies, to then apply adhesive to the preferably plate-like first connecting members on a surface thereof facing toward the surface of the wall for covering, and to finally arrange the wall covering in its entirety on the surface of the wall for covering. The wall covering can then be released again in its entirety or in separate components from the surface of the wall for covering by unscrewing the bolts from the connecting assemblies. A particular advantage of applying adhesive to connect the preferably plate-like connecting member to the surface of the wall for covering is that connection is possible without heat being applied to the surface for covering, as is for instance the case with welding. This has for instance the advantage that determined properties of the wall for covering, such as corrosion resistance, are not adversely affected.

The present invention also relates to a wall-covering element for forming a system according to the invention as described above.

In a favourable embodiment hereof the wall-covering element comprises:

- an upper wall with an upper surface which, when the wall-covering element has been arranged on a surface of a wall for covering, faces away from the surface for covering, and a lower surface;
- two first side walls extending on both longitudinal sides of the upper wall from the lower surface and substantially transversely of the upper surface;
- two lower walls extending on the longitudinal sides of the first side walls remote from the upper wall and substantially transversely of the side walls and in the same plane;

wherein more preferably the ends of the lower walls remote from the first side walls are directed toward each other; and wherein most preferably two second side walls extending on the longitudinal sides of the lower walls remote from the first side walls substantially transversely of the lower walls in parallel planes in the direction of the lower surface of the upper wall, wherein the ends of the second side walls remote from the lower walls are situated a distance from the lower surface of the upper wall.

In a favourable embodiment the wall-covering element according to the invention comprises a tubular cavity, wherein the wall of the cavity comprises an opening extending in the lengthwise direction.

A further favourable embodiment of the wall-covering element according to the invention comprises:

a core layer with an upper surface and a number of side surfaces, and a cover layer covering the upper surface and at least one side surface of the core layer.

These measures make it for instance possible for the core layer to be formed from a material which imparts an exceptional bending stiffness to the core layer and for the cover layer to be formed from another material which gives the cover layer for instance the appearance of a teak element.

In a favourable embodiment hereof the core layer is hollow.

In a favourable embodiment of the wall element according to the invention with a core layer and a cover layer arranged thereon as well as an upper wall, two first side walls and two lower walls, the core layer comprises at least the upper wall, the first side walls and the lower walls.

The present invention also relates to a coupling element for forming a system according to the invention as described above. The present invention also relates to a wall covering formed by means of a system according to the invention as described above, comprising a number of first wall-covering elements;

two mounting assemblies, each comprising a second wall-covering element and a connecting assembly for releasable connection of the second wall-covering element to the surface of the wall for covering; and at least two first coupling elements, wherein each of the first wall-covering elements is coupled by means of at least one of the first coupling elements to the mounting assemblies.

In a favourable embodiment hereof the first wall-covering elements and the second wall-covering elements are elongate elements, and the first wall-covering elements and the mounting assemblies are coupled by means of the first coupling elements such that the second wall elements each extend on a transverse side of the first wall-covering elements so that the longitudinal direction of the first wall-covering elements is oriented transversely of the longitudinal direction of the second wall-covering elements.

In a further favourable embodiment hereof the coupling elements comprise:

a number of first engaging members which are in engagement with one of the first wall-covering elements on a transverse side thereof; and a number of second engaging members which are in engagement with one of the second wall-covering elements on a longitudinal side thereof;

so that the first wall-covering element is connected via the second wall-covering element to the connecting assembly of the mounting assembly.

The present invention also relates to a method for covering a surface of a wall, preferably the surface of a wall of a ship, more preferably the surface of the deck of a ship, comprising the steps of:

(a) coupling a number of first wall-covering elements to two mounting assemblies by means of in each case at least one first coupling element, wherein each mounting assembly comprises a second wall-covering element and a connecting assembly;

(b) releasably connecting the mounting assemblies and the first wall-covering elements coupled thereto to the surface of the wall for covering by means of the connecting assemblies.

The method enables exceptionally simple and effective arranging of a wall covering on a surface of a wall for covering.

In a favourable embodiment hereof the first and second wall-covering elements are elongate and step (a) comprises of:

coupling each of the transverse sides of the first wall-covering elements to in each case a longitudinal side of one of the second wall-covering elements, and step (b) comprises of:

releasably connecting the second wall-covering elements by means of the connecting assemblies to the surface of the wall for covering.

In a favourable embodiment of the method according to the invention a single connecting assembly comprises:

a number of first connecting members for placing the connecting assembly into engagement with the surface of the wall for covering; and a number of second connecting members for placing the connecting assembly into releasable engagement with a second wall-covering element; and wherein the method also comprises the step of:

(c) placing the first connecting members into non-releasable engagement with the surface of the wall for covering; and (d) placing the second wall-covering elements into releasable engagement with the first connecting members by means of the second connecting members.

In a favourable embodiment hereof step (b) comprises step (c) and step (d), and step (d) is performed before step (c). These measures enable an exceptionally simple arrangement of a wall covering according to the invention in its entirety on a surface of a wall for covering.

In a favourable embodiment of the method according to the invention wherein the first wall-covering elements are elongate, this also comprises the step of coupling the longitudinal sides of adjacent first wall-covering elements by means of a number of second coupling elements.

The present invention also relates to a method for replacing a first wall-covering element of a wall-covering element according to the invention as described above arranged on a surface of a wall for covering, comprising the steps of:

releasing the second wall-covering elements of the mounting assembly from the surface of the wall for covering; and uncoupling a first wall-covering element to be replaced from the mounting assemblies;

coupling a replacement first wall-covering element to the mounting assemblies by means of a number of the first coupling elements;

connecting the second wall-covering elements releasably to the surface of the wall for covering.

These measures enable an exceptionally simple and rapid replacement of a first wall-covering element.

The invention also relates to a ship provided with a system according to the invention as described above.

The present invention will be further elucidated hereinbelow on the basis of an exemplary embodiment as shown in the accompanying drawing. This is a non-limitative exemplary embodiment. The same or similar parts, components and elements are designated in the figures with the same reference numerals. In the drawing.

Figure 1:
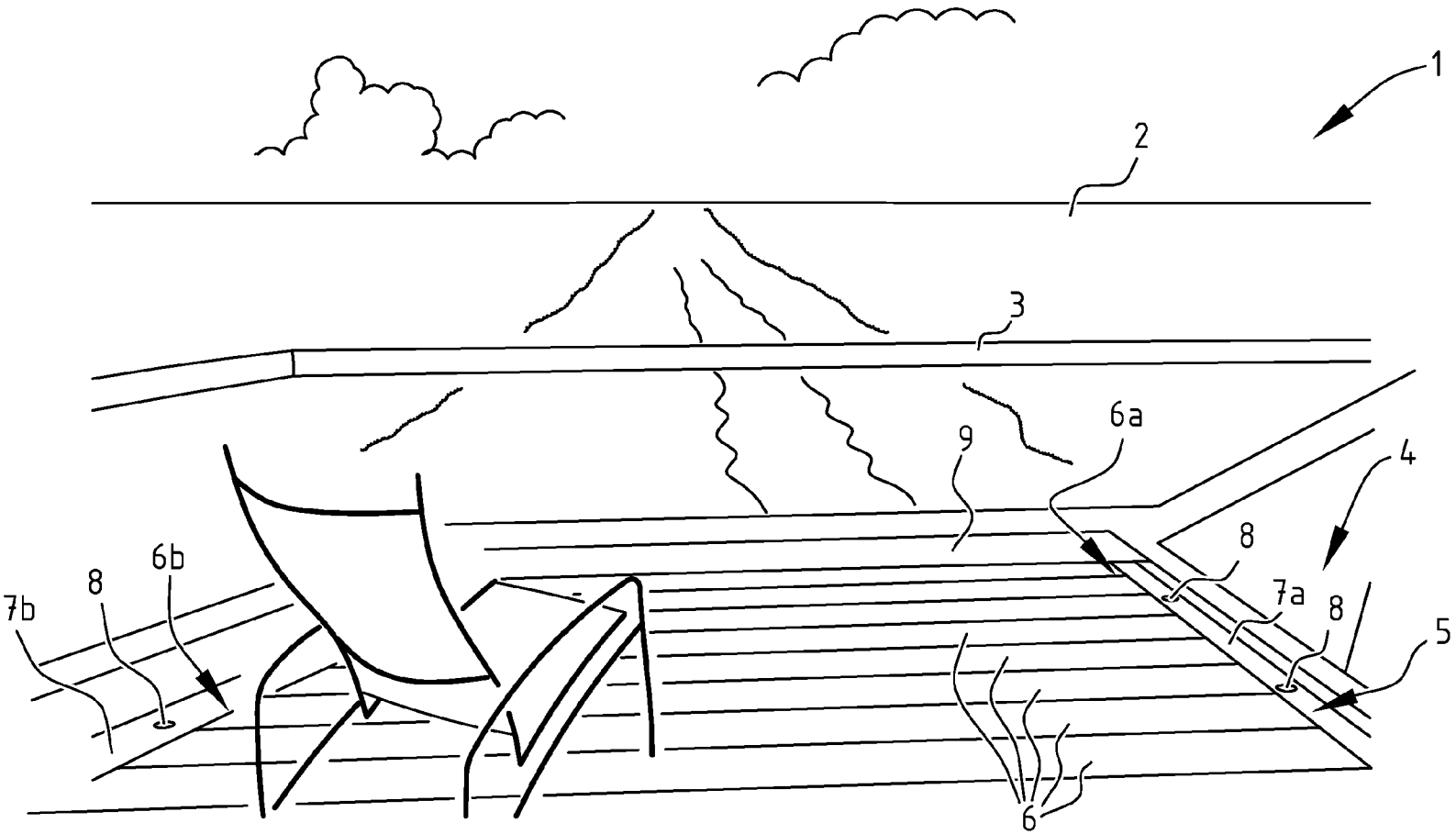
FIG. 1 is a perspective view of a balcony of a cruise ship provided with a wall covering formed by means of a system according to the invention.

FIG. 1 shows a balcony 1 of a cruise ship sailing on an ocean 2. The balcony is provided with a balustrade 3. A wall covering 5 is arranged on the surface of the wall of the cruise ship forming the deck 4 of balcony 1. Wall covering 5 is shown with a number of elongate first wall-covering elements 6 lying parallel to each other and a second wall-covering element 7*a* extending along a transverse side 6*a* of the first wall-covering elements 6. A second second wall-covering element 7*b* extends along the opposite transverse side 6*b* of the first wall-covering elements 6. This second wall-covering element is only partially visible in FIG. 1. The first wall-covering elements 6 are coupled by means of first coupling elements on the transverse side 6*a*, 6*b* thereof to the second wall-covering elements 7*a*, 7*b* on the longitudinal side thereof. These coupling elements are not shown in FIG. 1. The second wall-covering elements 7*a*, 7*b* are connected by means of connecting assemblies to the wall of the ship on which wall covering 5 is arranged. Only the nuts 8 of the connecting assemblies are visible in FIG. 1. A gutter 9 is provided round wall covering 5 in FIG. 1. A deck-chair is also placed on wall covering 5.

Figure 2:
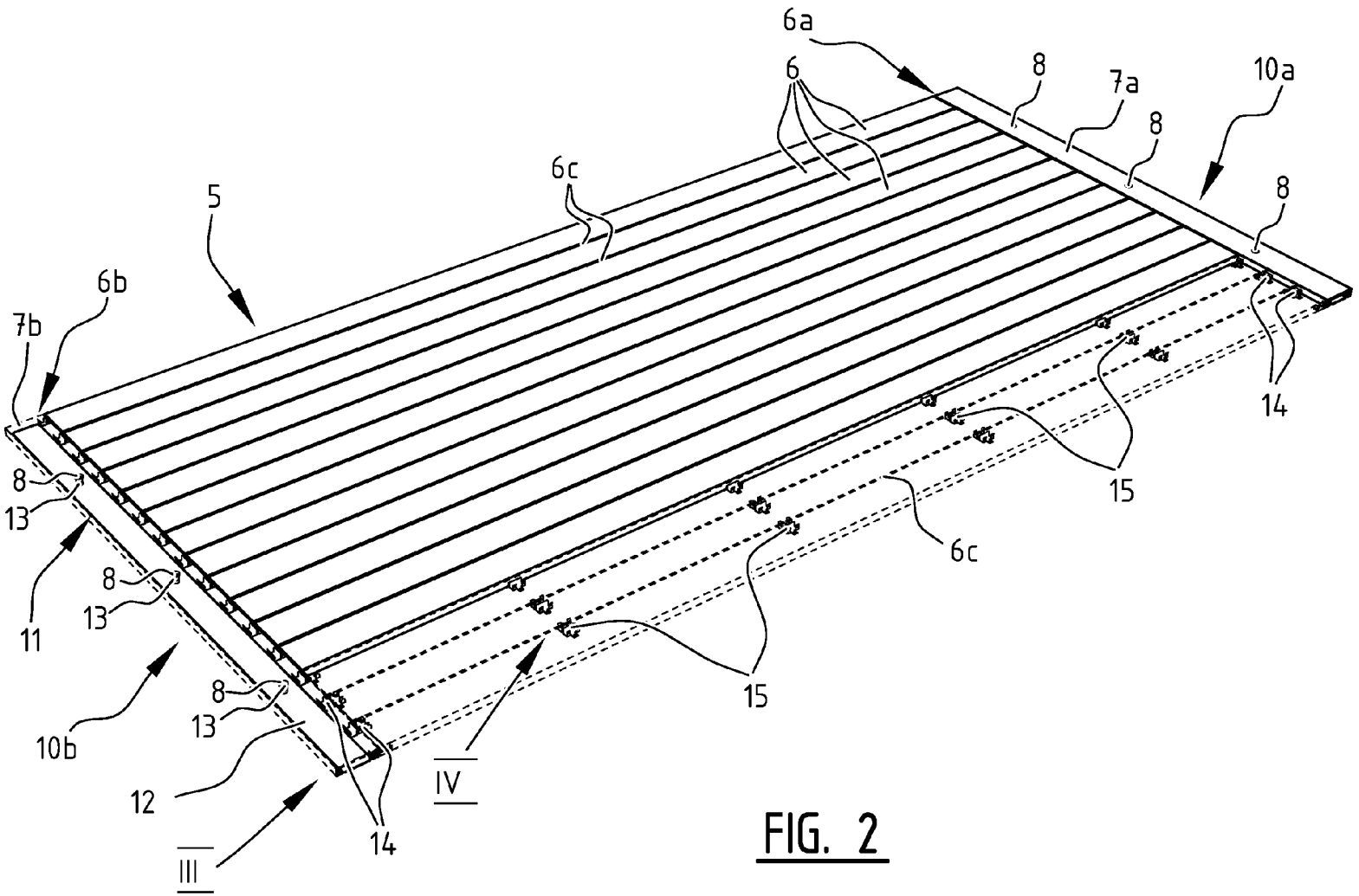
FIG. 2 is a perspective view with partly broken-away parts of a wall covering formed by means of a system according to the invention.

FIG. 2 shows in more detail a part of wall covering 5 of FIG. 1. In contrast to what is shown of wall covering 5 in FIG. 1, FIG. 2 does show fully that elongate second wall-covering elements 7*a*, 7*b* extend along transverse sides 6*a*, 6*b* of the elongate first wall-covering elements 6. One of the second wall-covering elements 7*b* is shown schematically by means of broken lines in order to show that the second wall-covering elements 7*a* and 7*b* form part of two mounting assemblies 10*a* and 10*b*. Of the mounting assembly 10*a* only the second wall-covering element 7*a* and bolts 8 can be seen in FIG. 2. FIG. 2 shows that mounting assembly 10*b* comprises the second wall-covering element 7*b*, represented schematically by means of a broken line, as well as a connecting assembly 11. This connecting assembly 11 is formed in FIG. 2 by a plate-like first connecting member 12 with a mesh structure which, by means of for instance adhesive, is in non-releasable engagement with the surface of the wall on which wall covering 5 is arranged, and a number of second connecting members in the form of three bolts 13 arranged on the plate-like first connecting member and three nuts 8 co-acting therewith. The three bolts 13 arranged on the plate-like first connecting member and the three nuts 8 co-acting therewith serve to place connecting assembly 11 into engagement with the second wall-covering element 7*b*. The second wall-covering element 7*b* is connected releasably by means of connecting assembly 11 to the surface of the wall on which wall covering 5 is arranged. The second wall-covering element 7*a* of mounting assembly 10*a* is releasably connected in the same manner by means of a connecting assembly to the surface of the wall on which wall covering 5 is arranged. Of this connecting assembly only bolts 8 are visible in FIG. 2.

FIG. 2 also shows that two adjacent first wall-covering elements 6 at a time are coupled on the transverse sides 6*a*, 6*b* thereof to the longitudinal side of the second wall-covering elements 7*a*, 7*b* by means of first coupling elements 14, and are thus connected by means of connecting assemblies 11 of mounting assemblies 10*a*, 10*b*, via the second wall-covering elements 7*a*, 7*b*, to the wall on which wall covering 5 is arranged. FIG. 2 also shows that two adjacent first wall-covering elements 6 at a time are connected to each other on the longitudinal sides 6*c* by means of second coupling elements 15. When the first and second coupling elements are not fixed to the surface of the wall, the wall covering 5, except for the plate-like first connecting members 12 adhered to the surface of the wall and the bolts 13, can be removed in its entirety from the surface of the wall after nuts 8 have been unscrewed. Following removal of wall covering 5 the surface of the wall can then be easily cleaned. After cleaning the removed wall covering 5 can then be re-placed in simple manner and fixed to the surface of the wall for covering by positioning second wall-covering elements over bolts 13 and screwing nuts 8 onto bolts 13.

FIGS. 3A to 3D show in detail the components of the system according to the invention with which wall covering 5 FIGS. 1 and 2 is formed for the purpose of elucidating the mutual relation thereof within the system as well as the manner in which the components can be mutually coupled. Shown are a first wall-covering element 6, a second wall-covering element 7, two first coupling elements 14, a nut 8, a bolt 13 and a plate-like first connecting member 12. The plate-like first connecting member 12 is connected non-releasably, for instance by means of adhesive, to surface 16 of a wall for covering. Arranged on the plate-like first connecting member 12 is a bolt 13 which can co-act with nut 8, which nut 8 can be placed through hole 17 in second wall-covering element 7 so as to place nut 8 into engagement with bolt 13 and thus connect the second wall-covering element 7 releasably to surface 16. Bolt 13 and nut 8 form second connecting members here which, together with the plate-like second connecting member 12, form the connecting assembly 11 with which the second wall-covering element 7 can be connected to surface 16. Connecting assembly 11 and second wall-covering element 7*b* together form a mounting assembly 10*b* to which the first wall-covering element 6 can be coupled by means of first coupling elements 14.

Shown is that the first wall-covering element 6 and the second wall-covering element 7*b* both have an upper wall 18 with an upper surface 18*a* which, when wall-covering element 6, 7 has been arranged on surface 16, forms the surface facing away from the surface 16 for covering, and a lower surface 18*b*. Two first side walls 19, 20 extend on both longitudinal sides of upper wall 18 from lower surface 18*b* and substantially transversely of upper surface 18*a*. Two lower walls 21, 22 extend substantially transversely of the first side walls and in the same plane on the longitudinal sides of first side walls 19, 20 remote from upper wall 18, wherein the ends of lower walls 21, 22 remote from first side walls 19, 20 are directed toward each other. Two second side walls 23, 24 extend, on the longitudinal sides of lower walls 21, 22 remote from first side walls 19, 20, substantially transversely of lower walls 21, 22 in parallel planes in the direction of lower surface 18*b* of upper wall 18, wherein the ends of the two side walls 23, 24 remote from lower walls 21, 22 are situated a distance A from lower surface 18*b* of upper wall 18. Also shown is that upper wall 18, first side walls 19, 20, lower walls 21, 22 and second side walls 23, 24 form a hollow core layer with an upper surface 18*a* and a number of side surfaces 19*a*, 20*a* and that a cover layer 40 covers upper surface 18*a* and side surfaces 19*a*, 20*a* of the core layer. The core layer and the cover layer are for instance of a differing plastic material, wherein the cover layer has for instance the appearance of a teak covering element by means of a processing of the surface thereof. Upper wall 18, first side walls 19, 20, lower walls 21, 22 and second side walls 23, 24 together also form a number of cavities 41 and 43. Cavities 41 and 43 extend from a side surface on the transverse side of the wall-covering elements in the lengthwise direction of the wall-covering elements. Cavity 43 also extends from the lower surface on the underside of the wall-covering elements in the direction of the upper side of the wall-covering elements. First coupling elements 14 are shown with a number of first engaging members 25*a* which can be placed into engagement with the first wall-covering elements 6 on a transverse side thereof. The first engaging members 25*a* and first wall-covering element 6 both have a number of engaging surfaces, these engaging surfaces being embodied such that the first wall-covering element 6 and the first engaging members 25*a* can be placed into form-fitting engagement with each other, wherein first engaging members 25*a* can be placed into an engaged state with the first wall-covering element 6 only in the longitudinal direction B of the first wall-covering element 6.

Figure 3A:
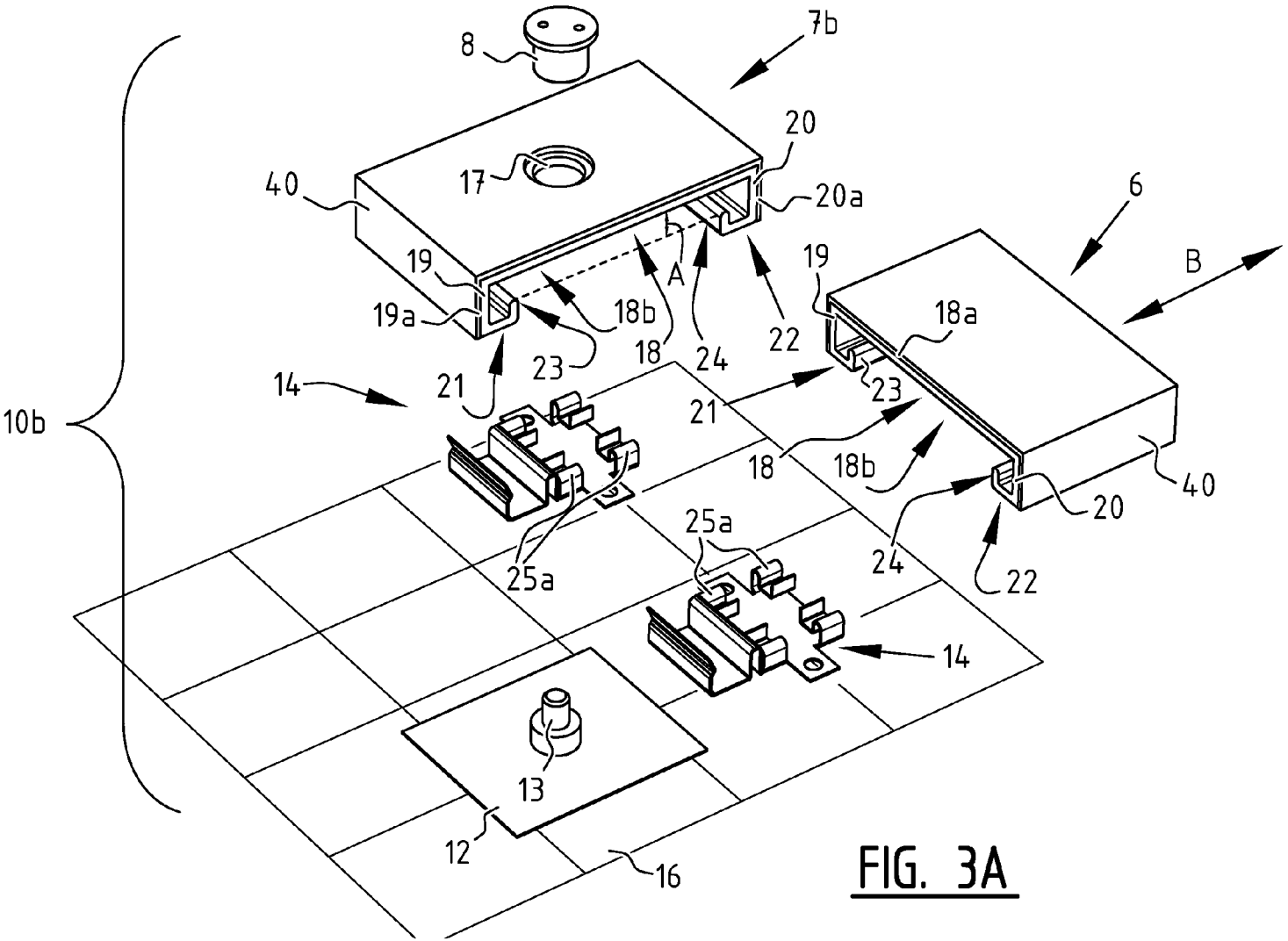
FIGS. 3A to 3D show perspective views of a detail of the wall covering of FIG. 2 indicated with arrow III.
Figure 3B:
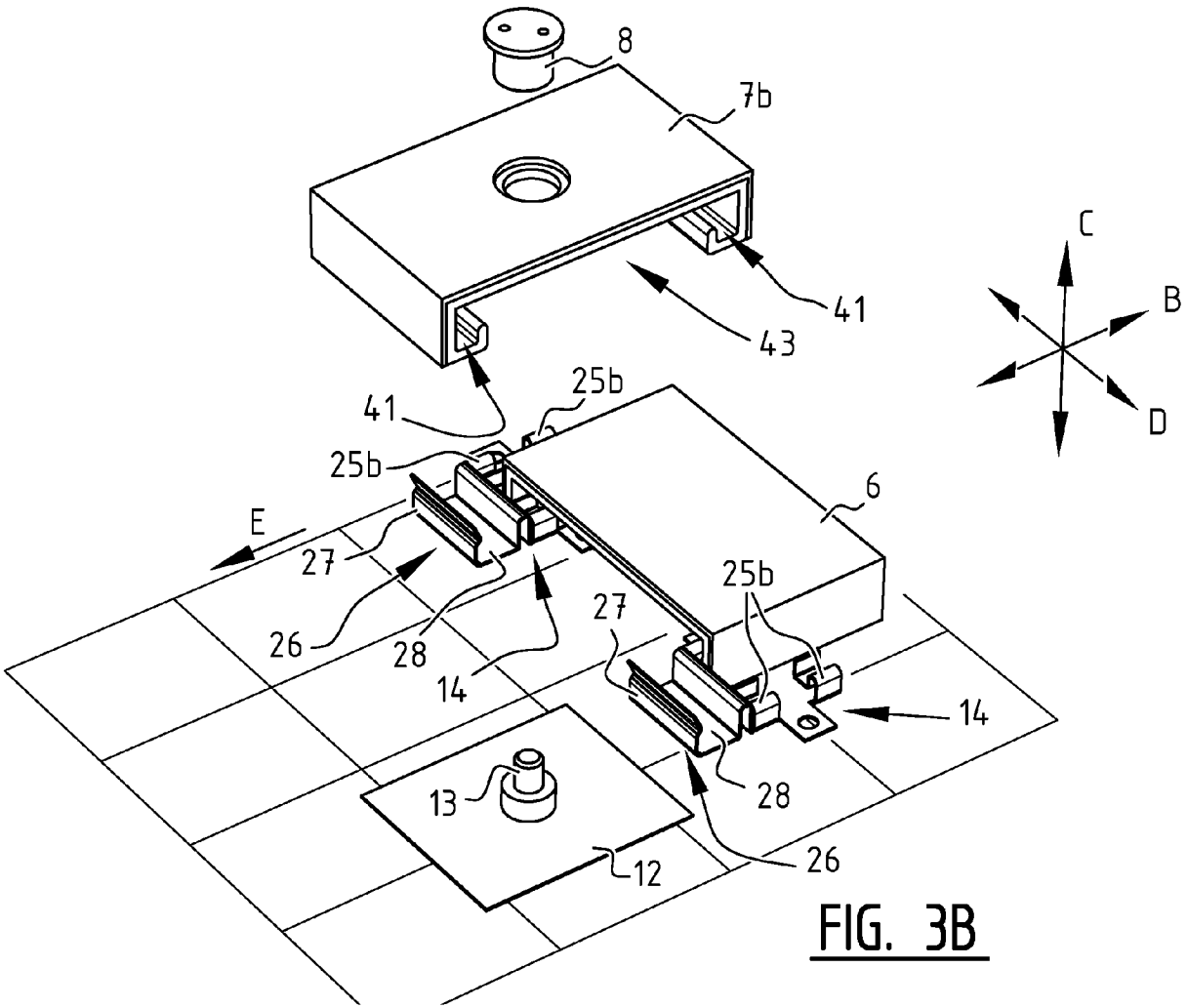

FIG. 3B shows that the first engaging members 25*a* have been placed into engagement with the first wall-covering element 6. First engaging members 25*a* and first wall-covering element 6 are embodied such that a displacement of first wall-covering element 6 relative to first engaging member 25*a* in a direction C, D substantially transversely of the longitudinal direction B of first wall-covering element 6 is prevented. First engaging members 25*a* can be moved out of the engaged state with the first wall-covering element 6 only in the longitudinal direction B of first wall-covering element 6.

Figure 3C:
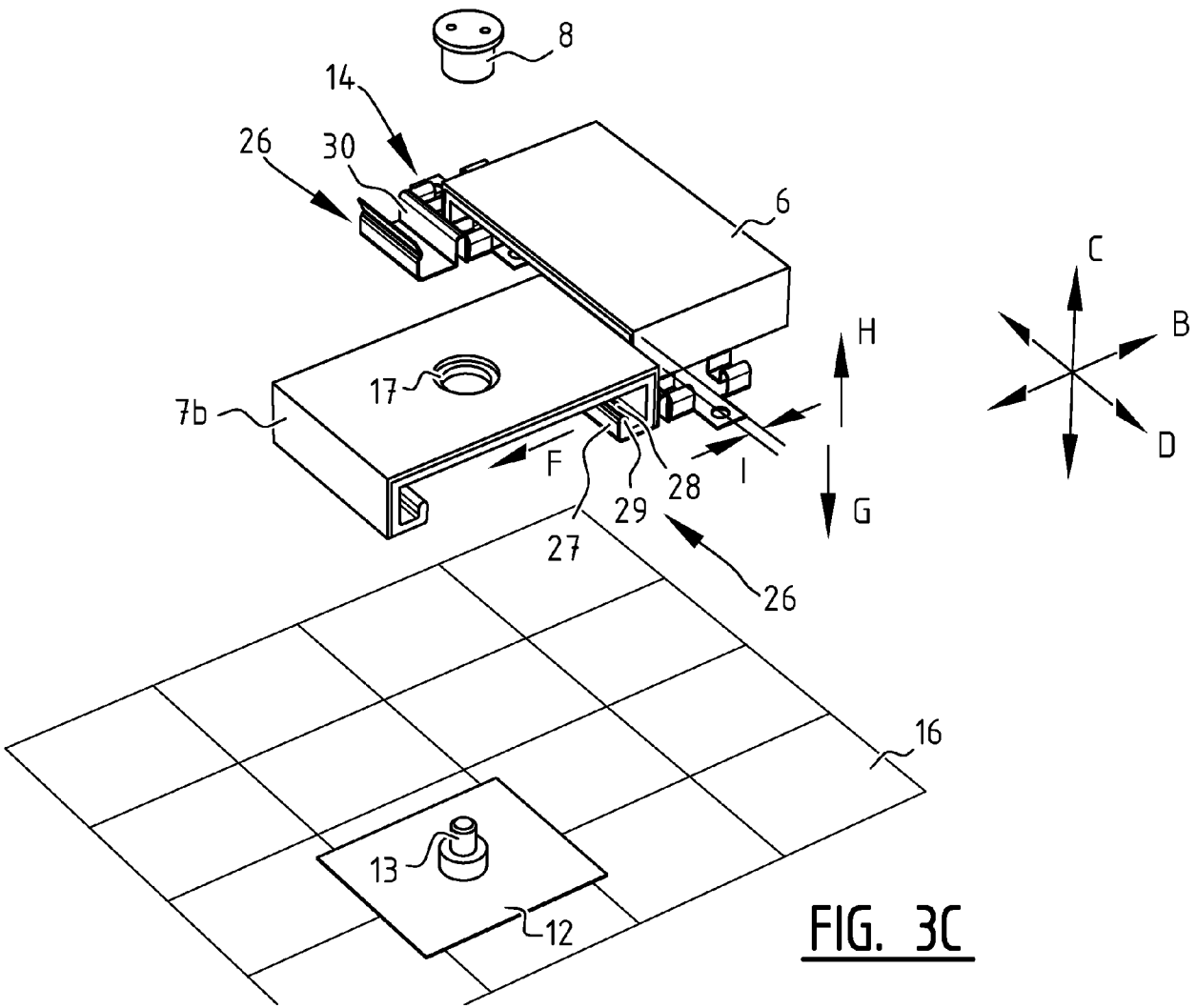

Also shown in FIG. 3B is that first coupling elements 14 are also provided with first engaging members 25*b* so that coupling elements 14 can each be placed into engagement with two adjacent first wall-covering elements 6. Coupling elements 14 are further provided with a second engaging member 26 which can be placed into engagement with the second wall-covering element 7 on a longitudinal side thereof. Second engaging member 26 and second wall-covering element 7*b* both have a number of engaging surfaces, these engaging surfaces being embodied such that second wall-covering element 7*b* and second engaging member 26 can be placed into form-fitting engagement with each other. Second engaging member 26 has a snap finger 27 having an engaging surface 28 on a free end thereof. Second engaging member 26 and second wall-covering element 7*b* are embodied such that, by bending the snap finger outward in the direction of arrow E, engaging surface 28 on the free end thereof can be displaced such that second engaging member 26 can be placed into an engaged state with the second wall-covering element 7*b* in a direction C transversely of the longitudinal direction D of the second wall-covering element 7*b*. This engaged state with the second wall-covering element 7*b* is shown in FIG. 3C, wherein engaging surface 28 on the free end of snap finger 27 is in engagement with an engaging surface 29 of the second wall-covering element 7*b*. In the situation shown in FIG. 3C a displacement of the second wall-covering element 7*b* relative to second engaging member 26 in a direction B, C substantially transversely of the longitudinal direction D of the second wall-covering element 7 is prevented until, by bending snap finger 27 outward in the direction of arrow F, engaging surface 28 on the free end thereof is displaced such that second engaging member 26 can be moved in a direction G transversely of the longitudinal direction D of second wall-covering element 7*b* out of the engaged state with second wall-covering element 7*b*. From the situation as shown in FIG. 3C, moving the second engaging members 26 out of the engaged state with the second wall-covering element 7*b* in a direction H from the underside to the upper side of the second wall-covering element 7*b* is blocked.

Also shown in FIG. 3C is that first coupling elements 14 comprise a spacer element 30 which holds at a distance I from each other the wall-covering elements 6, 7*b* mutually coupled by means of first coupling elements 14.

Figure 3D:
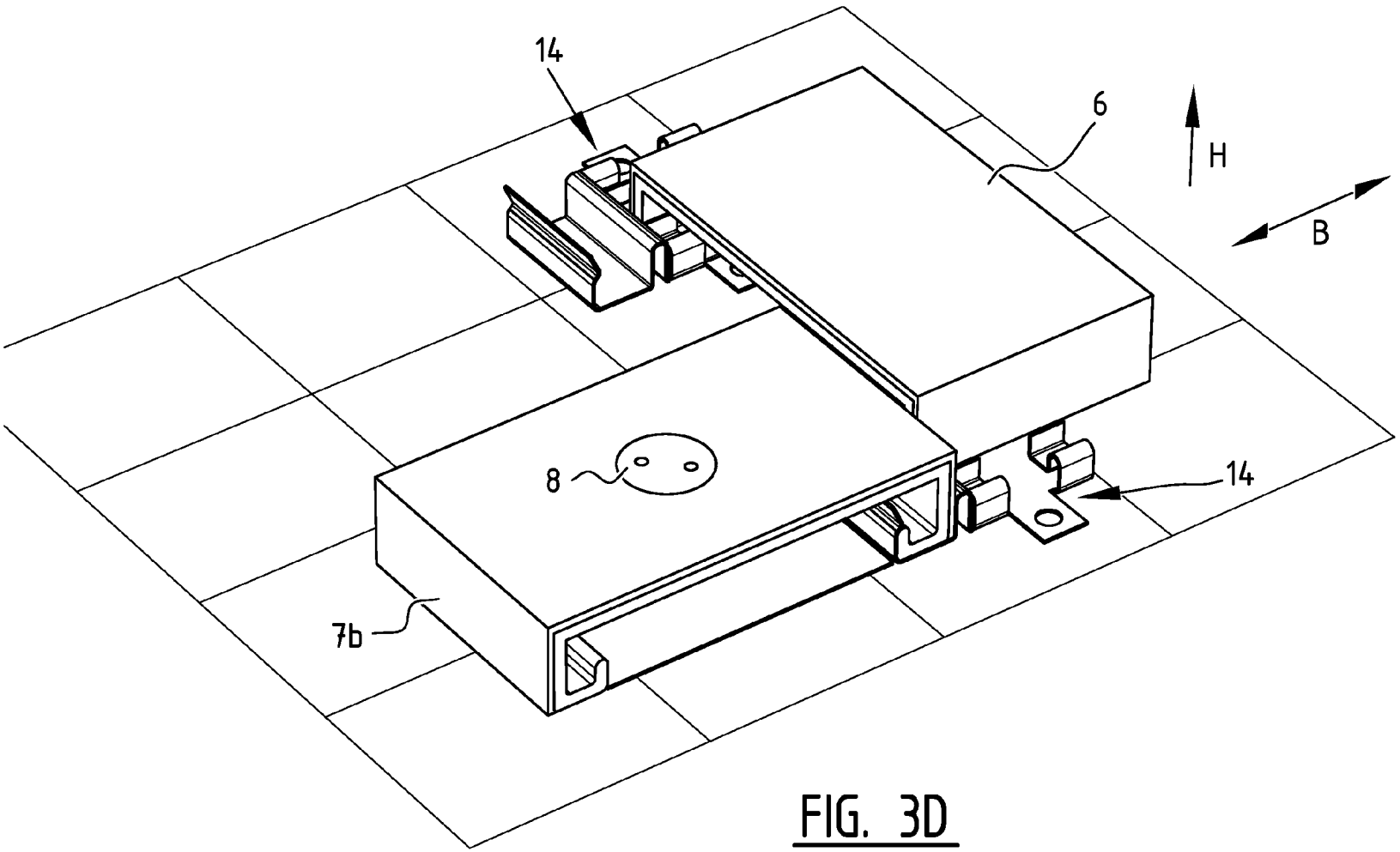

From the situation shown in FIG. 3C the coupled wall-covering elements 6 and 7*b* can be placed on surface 16 of the wall for covering, and the second wall-covering element 7*b* can be connected to surface 16 of the wall for covering by means of placing nut 8 through hole 17 and placing nut 8 into engagement with bolt 13. The situation is then realized as shown in FIG. 3D and FIG. 2. Because the other transverse side, not shown in FIG. 3D, of the first wall-covering element 6 is coupled to the second wall-covering element 7*a* of mounting assembly 10*a*, a displacement of the first wall-covering element 6 in the longitudinal direction B thereof is blocked. Owing to the embodiment of the first wall-covering element 6, the second wall-covering elements 7*a* and 7*b* and the first coupling elements 14 a displacement of the first wall-covering element 6 relative to the second wall-covering elements 7*a* and 7*b* in the direction of arrow H is also blocked, so that removal of the first wall-covering elements 6 is blocked as long as the second wall-covering elements 7*a*, 7*b* are connected via connecting assemblies 11 to surface 16 of the wall for covering.

Figure 4A:
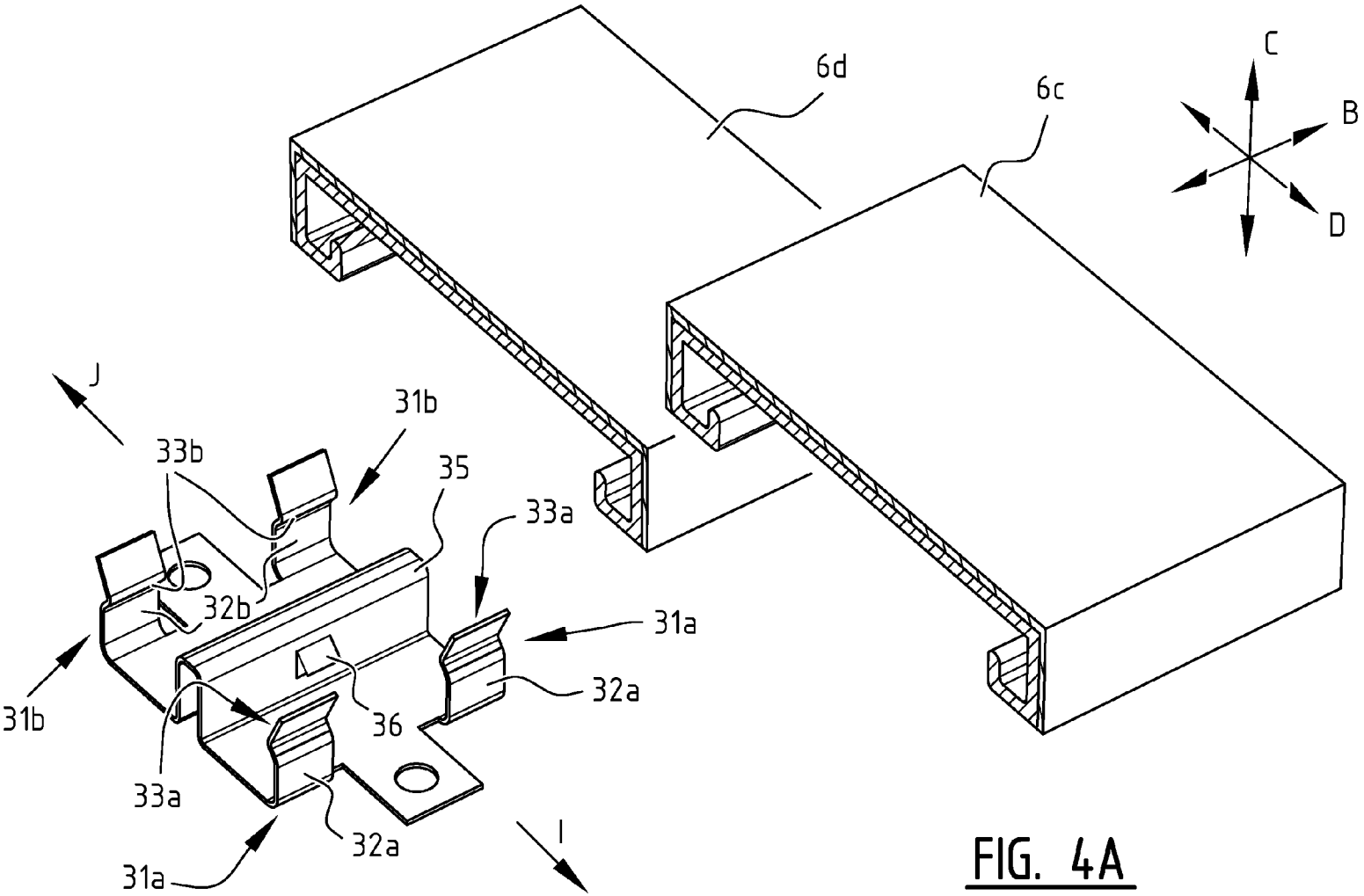
FIGS. 4A and 4B are perspective views of a detail of the wall covering of FIG. 2 indicated with arrow IV.
Figure 4B:
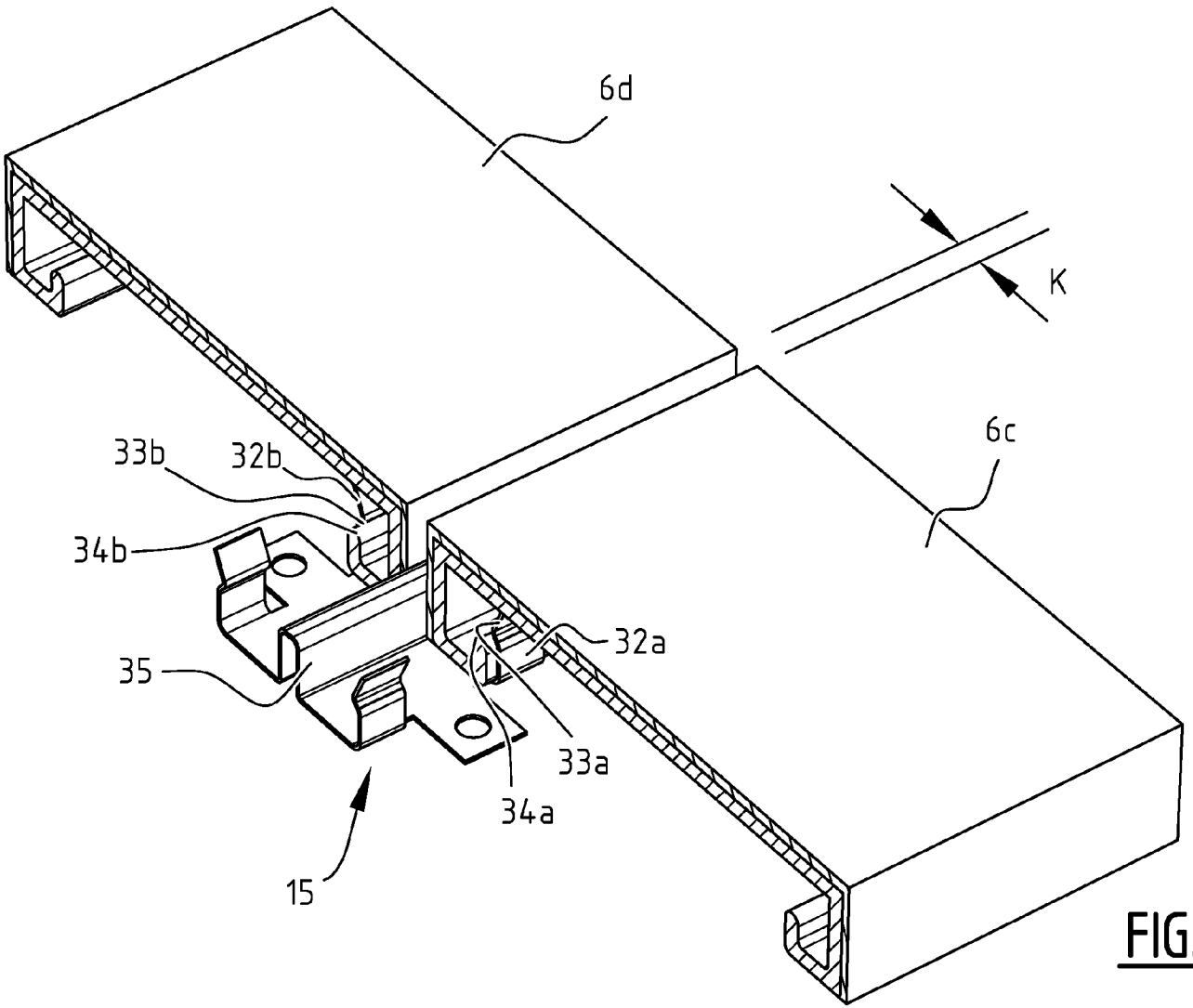

FIGS. 4A and 4B show in detail the components of the first wall-covering elements 6 and second coupling element 15 of the system according to the invention with which the wall covering 5 of FIGS. 1 and 2 is formed, this for the purpose of elucidating the mutual relation thereof within the system.

Second coupling element 15 has a number of third engaging members 31*a* which can be placed into engagement with the first wall-covering element 6*c* on a longitudinal side thereof and a number of third engaging members 31*b* which can be placed into engagement with the first wall-covering element 6*d* on a longitudinal side thereof. Third engaging members 31*a*, 31*b* and first wall-covering elements 6*c*, 6*d* both have a number of engaging surfaces, these engaging surfaces being embodied such that first wall-covering elements 6*c*, 6*d* and third engaging members 31*a*, 31*b* can be placed into form-fitting engagement with each other such that a displacement of first wall-covering elements 6*c*, 6*d* relative to third engaging members 31*a*, 31*b* in a direction C, D substantially transversely of the longitudinal direction B of first wall-covering elements 6*c*, 6*d* is prevented. The third engaging members 31*a*, 31*b* are provided for this purpose with a snap finger 32*a*, 32*b* having an engaging surface 33*a*, 33*b* on a free end thereof, wherein third engaging members 31*a*, 31*b* and first wall-covering elements 6*c*, 6*d* are embodied such that, by bending snap fingers 32*a*, 32*b* outward in the respective directions I and J, engaging surface 33*a*, 33*b* on the free end thereof can be displaced such that third engaging members 31*a*, 31*b* can be placed into an engaged state with first wall-covering elements 6*c*, 6*d* in a direction C transversely of the longitudinal direction B of first wall-covering elements 6*c*, 6*d*. This situation is shown in FIG. 4B, wherein engaging surface 33*a*, 33*b* on the free end of snap fingers 32*a*, 32*b* is in engagement with an engaging surface 34*a*, 34*b* of first wall-covering elements 6*c*, 6*d*.

Also shown in FIG. 4B is that the second coupling element 15 is provided with a spacer element 35 in order to hold at a distance K from each other the two wall-covering elements 6*c*, 6*d* mutually coupled by means of coupling element 15. As shown in FIG. 4A, a barb 36 is realized on spacer element 35 which additionally avoids a wall-covering element being detached from second coupling element 15. This barb 36 is optional, and is for instance not shown in FIG. 4B.

FIGS. 3A to 3D show coupling of one first wall-covering element to one first wall-covering element by way of illustrating the manner in which the components of the system can be mutually coupled. When arranging a wall covering on a surface with the system according to the invention with the components as shown in FIGS. 3A to 3D, a plurality of first wall-covering elements 6 are coupled to two second wall-covering elements 7*a* and 7*b* so that a wall covering 5 is formed as shown in FIG. 2.

FIGS. 3A to 3D show that the plate-like first connecting member is first placed into engagement with the surface of the wall for covering before the first wall-covering element is coupled to the second wall-covering element. Transposed to the wall covering as shown in FIG. 2, wall covering 5 is then first formed by coupling the first wall-covering elements to the second wall-covering elements, and the plate-like connecting members are adhered to the surface of the wall for covering. The formed wall covering 5 is then laid on the surface of the wall for covering and the second wall-covering elements are placed into engagement with the plate-like connecting elements by means of bolts and nuts.

It is however also possible for the first wall-covering element 6 to be first coupled to the second wall-covering element 7 and for the plate-like connecting element 12 to be placed into engagement with the second wall-covering element 7 before being placed into engagement with surface 16 of the wall for covering. The plate-like first connecting member 12 is then provided with for instance a layer of adhesive and the coupled wall-covering elements 6, 7 are placed together on the surface of a wall for covering. Transposed to wall covering 5 of FIG. 2, the wall covering 5 is then formed first, wherein connecting assemblies 11, including the plate-like first connecting members 12, are also placed into engagement with second wall-covering elements 7*a*, 7*b* before the plate-like first connecting members 12 are placed into engagement with surface 16 of the wall for covering. The plate-like first connecting members 12 are subsequently provided with for instance a layer of adhesive and the formed wall covering 5 is placed in its entirety on surface 16 of a wall for covering. During this placing the plate-like first connecting members 12 are then connected by means of the adhesive to the surface of the wall for covering, whereby wall covering 5 is then also connected in one operation to the wall for covering.

Figure 5A:
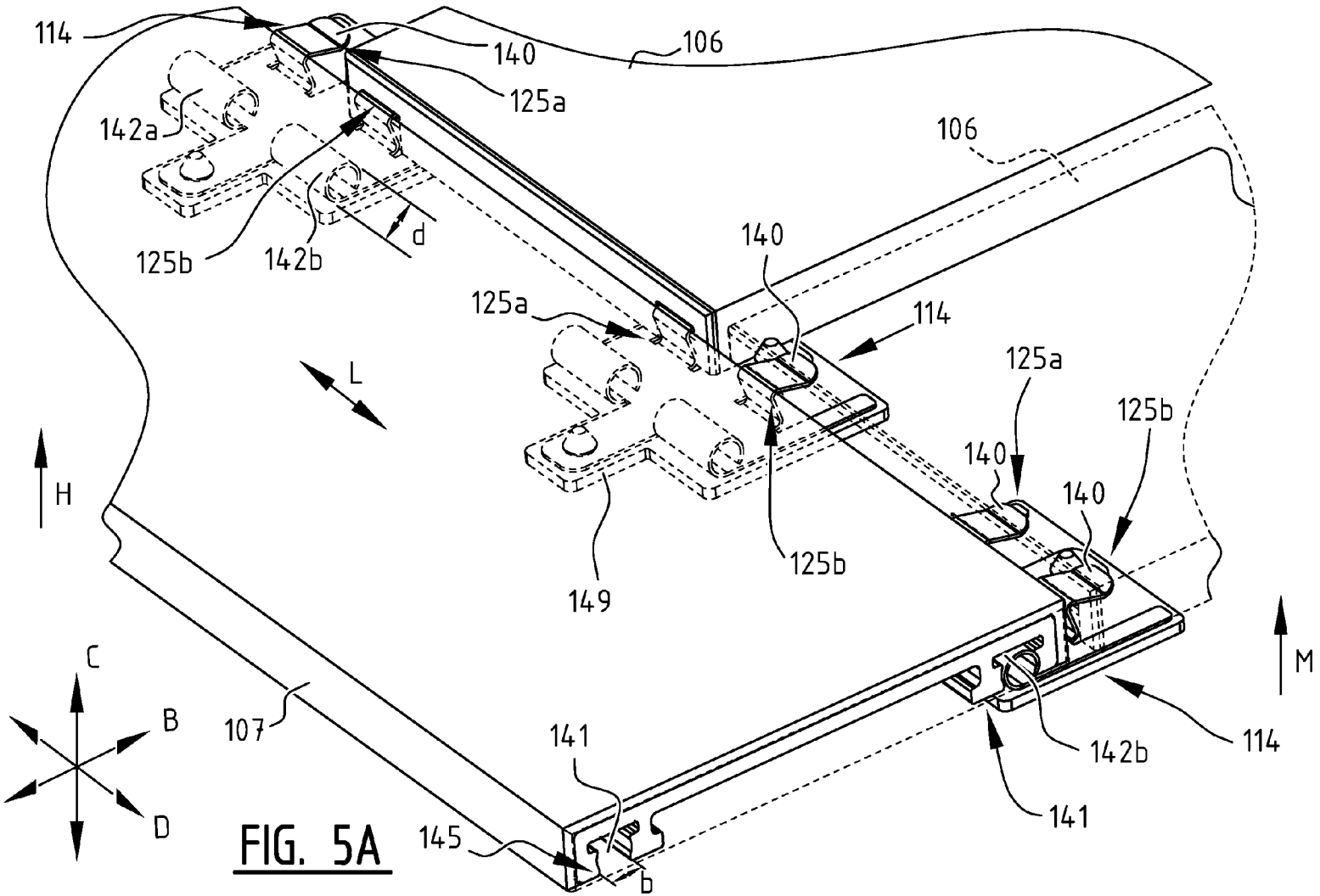
FIGS. 5A and 5B show an alternative embodiment of the wall-covering elements and first coupling elements of FIG. 3 in assembled and partially exploded views.
Figure 5B:
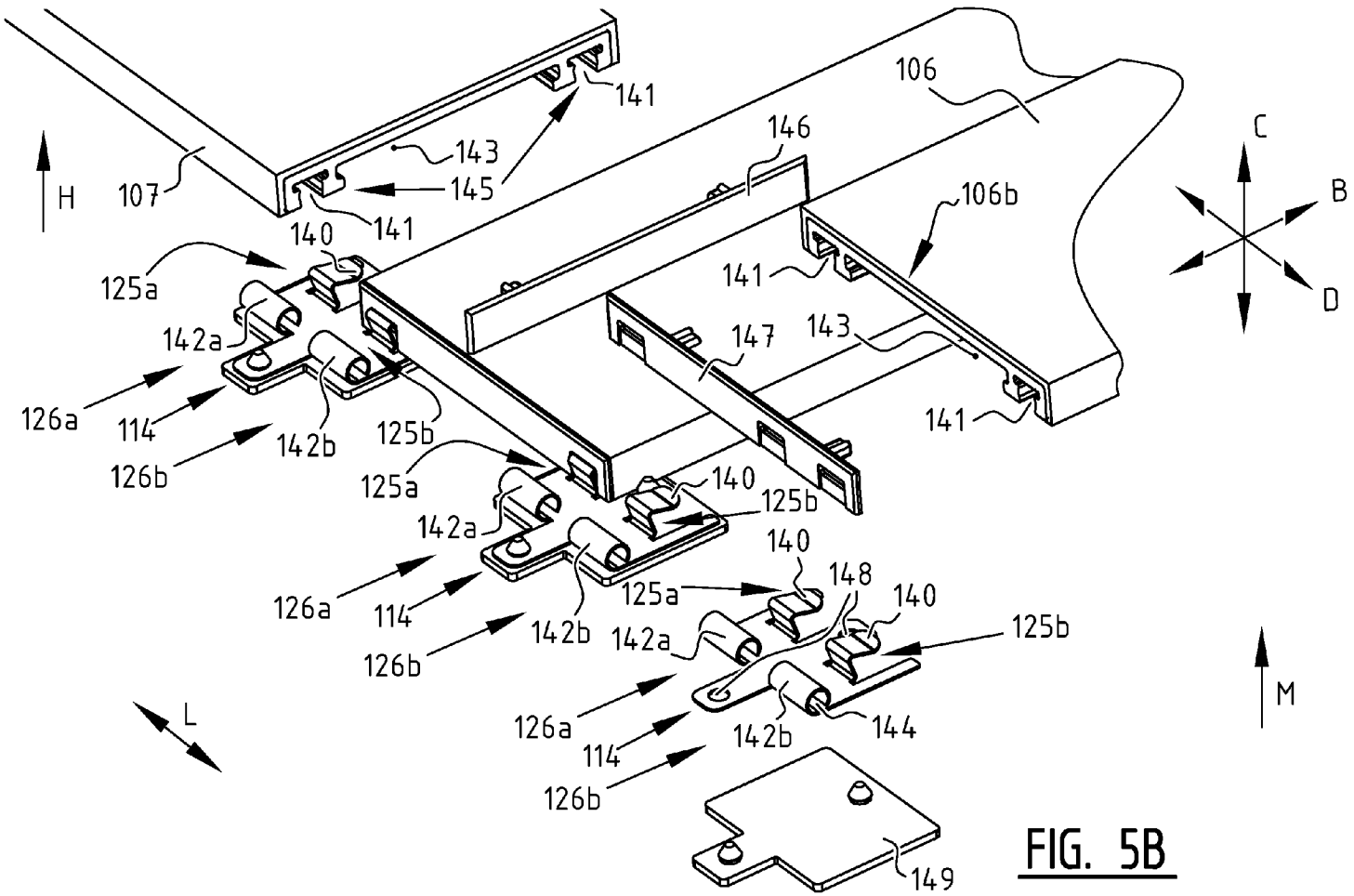

FIGS. 5A and 5B show an alternative embodiment of the wall-covering elements and coupling elements of FIGS. 3A to 3D. Shown are two first wall-covering elements 106, a second wall-covering element 107 and three first coupling elements 114. In FIG. 5A the components are shown in assembled state, in FIG. 5B in exploded view.

First coupling elements 114 are shown in FIG. 5A with a number of first engaging members 125*a*, 125*b* which have been placed into engagement with first wall-covering elements 106 on a transverse side thereof. As shown better in FIG. 5B, first engaging members 125*a*, 125*b* and first wall-covering elements 106 both have a number of engaging surfaces, these engaging surfaces being embodied such that first wall-covering elements 106 and first engaging members 125*a*, 125*b* can be placed in form-fitting engagement with each other, wherein first engaging members 125*a*, 125*b* can be placed in an engaged state with first wall-covering element 106 only in the longitudinal direction B of first wall-covering elements 106. The protruding part 140 of first engaging members 125*a*, 125*b* can be inserted here in a cavity 141 of first wall-covering elements 106, this cavity extending from the side surface on the transverse side 106*b* of first wall-covering elements 106 in the longitudinal direction B of first wall-covering elements 106. As long as the protruding part 140 extends in cavity 141 a displacement of first wall-covering elements 106 relative to first engaging members 125*a*, 125*b* in a direction C, D substantially transversely of the longitudinal direction B of first wall-covering elements 106 is prevented. From the assembled state as shown in FIG. 5A the first engaging members 125*a* can be moved out of the engaged state with a first wall-covering element 106 only in the longitudinal direction B of first wall-covering elements 106.

As shown in FIG. 5A, coupling elements 114 are further provided with second engaging members 126*a*, 126*b* which are in engagement with second wall-covering element 107*b* on a longitudinal side thereof.

As show more clearly in FIG. 5B, second engaging members 126*a*, 126*b* each have a spring element formed by a tubular body 142*a*, 142*b*. The wall of each tubular body 142*a*, 142*b* is cut through in the lengthwise direction L of the body so that an opening 144 is formed in the wall of tubular body 142*a*, 142*b*. Second wall-covering element 107*b* has two tubular cavities 141 extending on the longitudinal sides of second wall-covering element 107*b*. The wall of cavities 141 has an opening 145 extending in the lengthwise direction of cavity 141 so that tubular body 142*a*, 142*b* of the spring elements can be placed into one of the cavities 143 in order to place the second engaging members 126*a*, 126*b* into an engaged state with the wall-covering element 107. As shown in FIG. 5A, in the engaged state the outer surface of the wall of tubular body 142*b* is in contact with the inner surface of cavity 141 so that the spring elements are in form-fitting engagement with wall-covering element 107. Because the width b of opening 145 of cavity 143*b* is smaller than the diameter d of tubular bodies 142*a*, 142*b*, tubular bodies 142*a*, 142*b* can only be placed in cavity 141 in the direction M transversely of the lengthwise direction of wall-covering element 107 by deforming tubular bodies 142*a*, 142*b* and/or the wall of cavity 141. Tubular bodies 142*a*, 142*b* can be deformed for this purpose because the wall of tubular bodies 142*a*, 142*b* is cut through in the lengthwise direction L of the body.

In the situation shown in FIG. 5A a displacement of second wall-covering element 107*b* relative to second engaging members 126*a*, 126*b* in a direction B, C substantially transversely of the longitudinal direction D of second wall-covering element 106 is prevented. From the situation as shown in FIG. 5A moving second engaging members 26 out of the engaged state with second wall-covering element 107 is blocked in a direction H from the underside to the upper side of second wall-covering element 107.

Shown in FIGS. 5A and 5B is that, just as the first and second wall-covering elements of FIGS. 3A to 3D, the first and second wall-covering elements 106 and 107 have the same cross-section. Also shown in FIGS. 5A and 5B are cover elements 146 and 147 with which the transverse sides of the wall-covering elements can be covered. Such cover elements can also be applied in the embodiment of the system according to invention as shown in FIGS. 3A to 3D. Also shown is that first coupling elements 114 are provided with holes 148. These holes 148 are to be used to fix the first coupling elements 114 to the surface of a wall for covering or to a frame arranged on a wall for covering. A frame arranged on a wall for covering can for instance serve to bridge unevenness. Fixing of the first coupling elements to the surface of the wall for covering is for instance advantageous when a wall covering is being arranged on a vertical wall. As shown in FIG. 5B, holes 148 can also be used to fix separating element 149, for instance of rubber, to first coupling elements 114 for the purpose of separating first coupling elements 114 from the surface of the wall for covering. This separation can for instance serve the purpose of damping sound or protecting the surface of the wall for covering. The holes in the first and second coupling elements of FIGS. 3A to 3D and FIGS. 4A and 4B can be used in the same ways.

Figure 6:
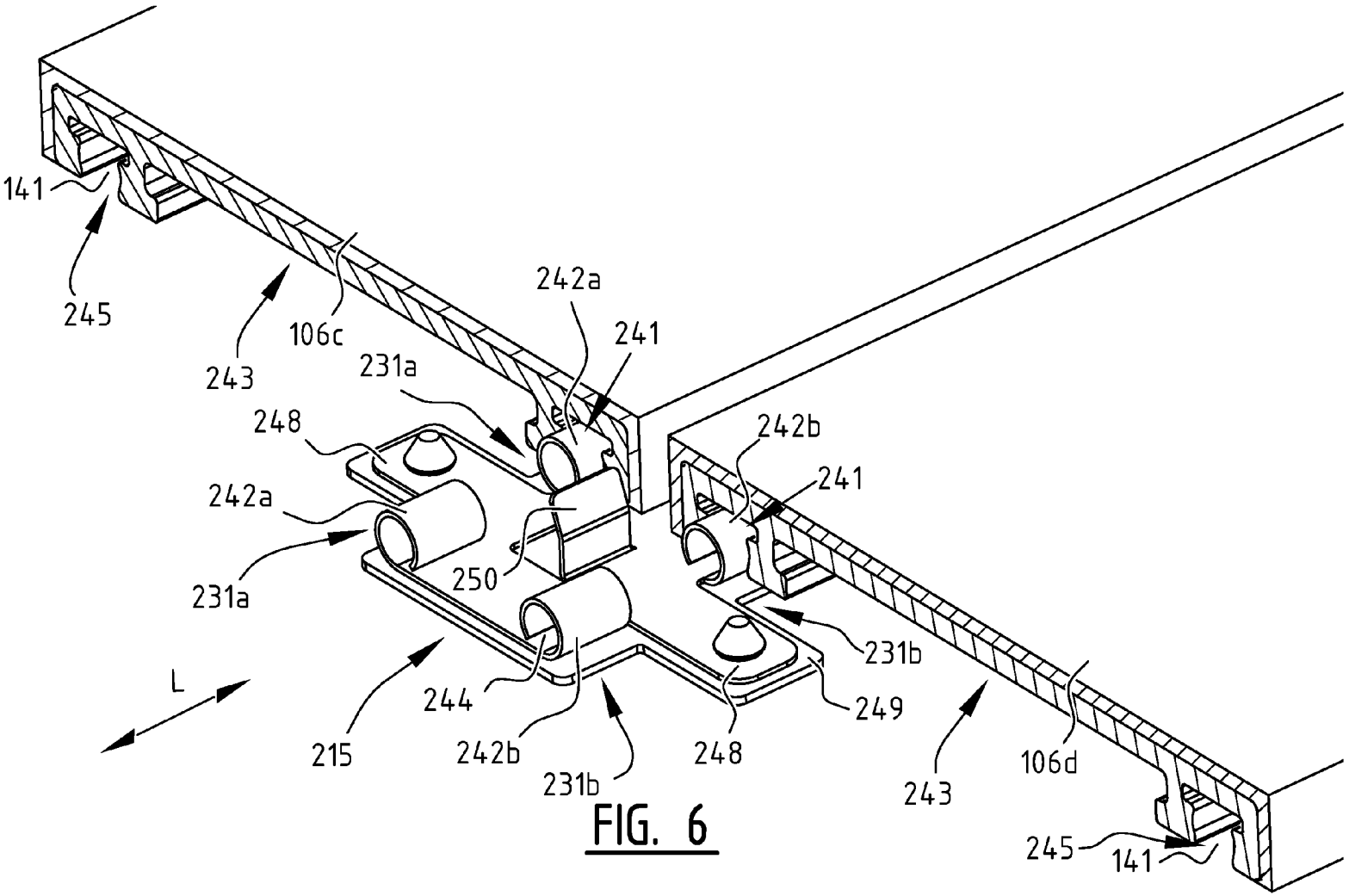
FIG. 6 shows an alternative embodiment of the first wall-covering elements and the second coupling element of FIG. 4.

FIG. 6 shows an alternative embodiment of the second coupling element of FIGS. 4A and 4B for use in combination with wall-covering elements 106, 107 and first coupling elements 114 of FIGS. 5A and 5B.

Second coupling element 215 has a number of third engaging members 231*a* which can be placed into engagement with first wall-covering element 106*c* on a longitudinal side thereof and a number of third engaging members 231*b* which can be placed into engagement with first wall-covering element 106*d* on a longitudinal side thereof.

Third engaging members 231*a*, 231*b* each have a spring element formed by a tubular body 242*a*, 242*b*. The wall of each tubular body 242*a*, 242*b* is cut through in lengthwise direction L of the body so that an opening 244 is formed in the wall of the body. First wall-covering elements 106*c*, 106*d* each have two tubular cavities 241 extending on the longitudinal sides of first wall-covering elements 106*c* and 106*d*. The wall of cavities 241 has an opening 245 extending in the lengthwise direction of cavity 241 so that tubular body 242*a*, 242*b* of the spring elements can be placed in one of the cavities 241 in order to place third engaging members 231*a*, 231*b* into an engaged state with wall-covering element 106*c*, 106*d*. As shown in FIG. 6, in the engaged state the outer surface of the wall of tubular bodies 242*b* is in contact with the inner surface of cavities 241 so that the spring elements are in form-fitting engagement with wall-covering element 106*c*, 106*d*. Just as in the case of the spring elements of the engaging members of FIGS. 5A and 5B, second coupling element 215 is provided with holes 248, by means of which a separating element 249 is connected to second coupling element 215. As shown in FIG. 6, second coupling element 215 is provided with a positioning element 250 which helps to position cavity 241 relative to tubular body 242*a*, 242*b*. This positioning element 250 is optional. Second coupling element 215 of FIG. 6 is not provided with a spacer element as is the second coupling element of FIGS. 4A and 4B, since tubular bodies 242*a*, 242*b* hold the adjacent first wall-covering elements 106*c* and 106*d* spaced apart.

Cavities 141, 143, 241, 243 of the wall-covering elements of FIGS. 5A, 5B and 6 extend from a side surface on the transverse side of the wall-covering elements in the lengthwise direction of the wall-covering elements. Owing to the openings 145, 245 in the walls of cavities 141, 241 these cavities also extend from the lower surface on the underside of the wall-covering elements in the direction of the upper side of the wall-covering elements.

Figure 7:
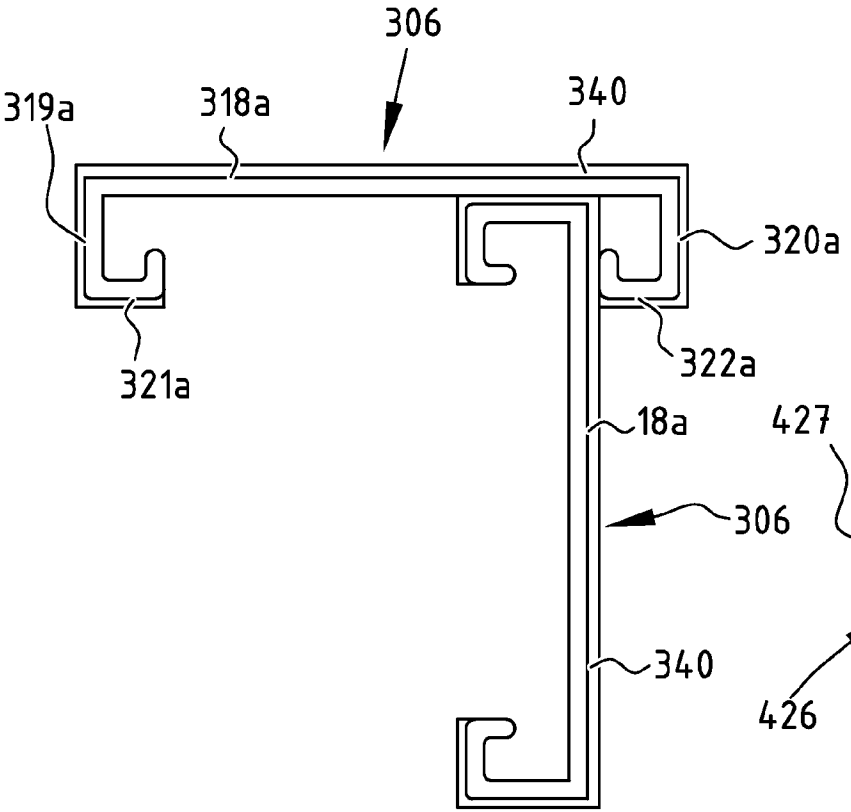
FIG. 7 is a cross-sectional view of two wall-covering elements according to the invention.

Although the figures show that the system according to the invention is applied to form a wall-covering element for covering a surface of a wall of a ship, it is also possible with the system according to the invention to cover walls of other constructions, for instance the floor of a balcony of a house. It is also possible with the system according to the invention to cover a wall extending at an angle relative to the horizontal plane, for instance a vertical wall. Shown in FIG. 7 is that two wall-covering elements 306 are positioned relative to each other in order to form a corner. The shown wall-covering elements differ from the wall-covering elements as shown in FIGS. 3A to 3D, 4A and 4B in that not only the upper surface 318*a* and side surfaces 319*a*, 320*a* of the core layer are covered with a cover layer 340, but also the lower surfaces 321*a* and 322*a*.

Figure 8:
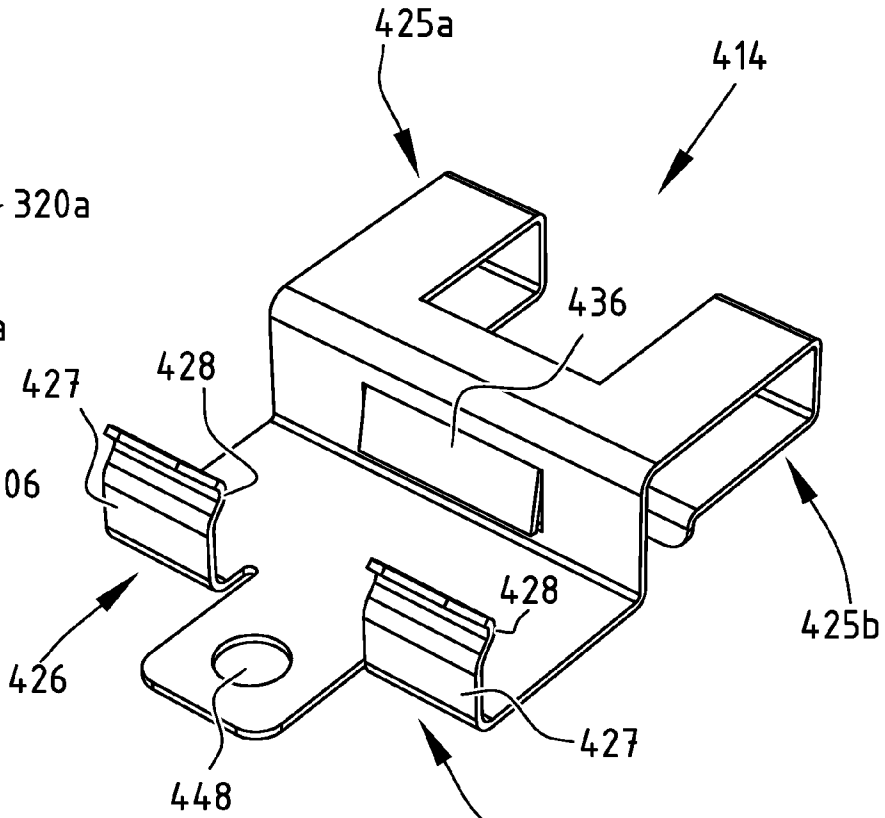
FIG. 8 is a perspective view of an alternative embodiment of the first coupling element as shown in FIG. 3A to 3D.

FIG. 8 shows an alternative embodiment of the first coupling element as shown in FIGS. 3A to 3D. First coupling element 414 is shown with a first engaging member 425*a* which can be placed into engagement with first wall-covering elements 6 of FIGS. 3A to 3D on the transverse side thereof. First engaging member 425*a* and first wall-covering element 6 both have a number of engaging surfaces, these engaging surfaces being embodied such that first wall-covering element 6 and first engaging members 425*a* can be placed into form-fitting engagement with each other, wherein first engaging member 425*a* can be placed in engaged state with first wall-covering element 6 only in the longitudinal direction B of first wall-covering element 6 as shown in FIG. 3A. First coupling element 414 is also provided with a second first engaging member 425*b* so that coupling element 414 can be placed into engagement with two adjacent first wall-covering elements 6 as shown in FIGS. 3A to 3D. Coupling element 414 is further provided with two second engaging members 426 which can be placed into engagement with second wall-covering element 7 of FIGS. 3A to 3D on a longitudinal side thereof. Second engaging members 426 have a snap finger 427 having an engaging surface 428 on a free end thereof. First coupling element 414 provided with a barb 436 avoids a second wall-covering element being detached from first coupling element 414. This barb 436 is optional. The first coupling element is also provided with a hole 448 for fixing first coupling elements 414 to the surface of a wall for covering, on a frame arranged on a wall for covering or on a separating element 149 as shown in FIG. 5B.

Shown in the figures is that the first engaging members are of the type which can be placed into engagement with a first wall-covering element, or moved out of an engaged state with the first wall-covering element, only in the longitudinal direction of the first wall-covering elements. It is also possible for the first engaging members to be embodied, just as the second and third engaging members, with a number of snap fingers so that a displacement of the first engaging members in a direction transversely of the longitudinal direction of the first wall-covering elements is prevented, but is however possible when the snap fingers are bent outward.

In the figures the first wall-covering elements can be connected via the second wall-covering elements to the surface of the wall for covering. It is also possible for the first wall-covering elements to be coupled directly to the connecting assemblies. In that case the first coupling element can be an integral part of the connecting assemblies.

In the figures the first and second coupling elements are separate elements. It is also possible for the first and/or second coupling elements to form an integral part of at least one of the first wall-covering elements and the second wall-covering elements. The first coupling elements can for instance form an integral part of the mounting assemblies, for instance of the second wall-covering elements, or of the plate-like first connecting members.

Shown in the figures is that the connecting assemblies of the mounting assemblies comprise a plate-like first connecting member and a number of bolts and nuts. The bolts can also be arranged directly on the surface of the wall for covering, for instance by means of welding. The bolts and nuts can also be embodied in other manner as releasable connection, for instance a snap connection instead of a screw connection.

Shown in the figures is that the wall covering is arranged with two mounting assemblies on the surface of the wall for covering. It is also possible for additional mounting assemblies to be applied, wherein these additional mounting assemblies are for instance oriented such that the second wall-covering elements thereof extend parallel to the lengthwise direction of the first wall-covering elements, and the longitudinal sides of these second wall-covering elements are coupled to the longitudinal side of an adjacent first wall-covering element by means of a second coupling element, as for instance shown in FIGS. 4A, 4B and 6.

The invention claimed is:

1. A system for covering a surface of a wall, comprising:

a plurality of first wall-covering elements;

two mounting assemblies, each comprising a second wall-covering element and a connecting assembly adapted to releasably connect the second wall-covering element to the surface of the wall for covering; and a plurality of first coupling elements adapted to couple the first wall-covering elements to the mounting assemblies;

wherein the system is configured such that the first wall-covering elements can be mounted via the first coupling elements on the surface for covering by means of the mounting assemblies;

the second wall-covering elements at least partially cover the connecting assemblies and the first coupling elements after connection; and the upper surface of the wall covering comprises the upper surface of the first wall-covering elements and the upper surface of the second wall-covering elements;

wherein each of the first coupling elements comprise:

a plurality of first engaging members which each can be placed into engagement with one of the first wall-covering elements on a transverse side of this first wall-covering element; and a plurality of second engaging members which each can be placed into engagement with one of the second wall-covering elements on a longitudinal side of this second wall-covering element;

so that the first wall-covering element is connected via the second wall-covering element to the connecting assembly of the mounting assembly.

2. A system as claimed in claim 1, wherein the first wall-covering elements and the second wall-covering elements are elongate elements; and the first wall-covering elements, the mounting assemblies and the first coupling elements are embodied such that the first wall-covering elements can be coupled to the mounting assemblies by means of the first coupling elements such that the second wall-covering elements each extend along a transverse side of the first wall-covering elements.

3. A system as claimed in claim 1, wherein the mounting assemblies, the first coupling elements and the first wall-covering elements are embodied such that, when the first wall-covering elements have been mounted by means of the mounting assemblies on a surface of a wall for covering, the removal of the first wall-covering elements is blocked as long as the second wall-covering elements are connected via the connecting assemblies to the surface of the wall for covering.

4. A system as claimed in claim 3, wherein the first engaging member and the first wall-covering elements are embodied such that the first engaging member can be placed into an engaged state with the first wall-covering elements only in the longitudinal direction of one or more of the first wall-covering elements and can be moved out of the engaged state with the first wall-covering element only in the longitudinal direction of the one or more first wall-covering elements, and wherein the second wall-covering elements comprise an underside which, when the second wall-covering elements have been connected to the surface of a wall for covering, faces toward the surface for covering and an upper side which faces away from the surface of a wall for covering, wherein the second engaging members and the second wall-covering elements are adapted such that moving the second engaging members out of the engaged state with the second wall-covering elements is blocked in a direction from the underside to the upper side of the second wall-covering elements.

5. A system as claimed in claim 4, wherein the first wall-covering elements comprise a cavity extending from a side surface on the transverse side of the first wall-covering elements in the lengthwise direction of the first wall-covering elements; and the first engaging members comprise a protruding part which can be inserted into the cavity of the first wall-covering elements in order to place the first engaging members into the engaged state with the first wall-covering element;

and wherein the second wall-covering elements comprise a cavity extending from a lower surface on the underside of the second wall-covering elements in the direction of the upper side of the second wall-covering elements; and the second engaging members comprise a protruding part which can be inserted into the cavity of the second wall-covering elements in order to place the second engaging members into the engaged state with the second wall-covering element.

6. A system as claimed in claim 1, wherein the first engaging member and the first wall-covering elements both comprise a number of engaging surfaces, these engaging surfaces being embodied such that the first wall-covering element and the first engaging member can be placed into form-fitting engagement with each other such that a displacement of the first wall-covering element relative to the first engaging member in a direction substantially transversely of the longitudinal direction of the first wall-covering element is prevented; and wherein the second engaging member and the second wall-covering elements both comprise a number of engaging surfaces, these engaging surfaces being embodied such that the second wall-covering element and the second engaging member can be placed into form-fitting engagement with each other so that a displacement of the second wall-covering element relative to the second engaging member in a direction substantially transversely of the longitudinal direction of the second wall-covering element is prevented.

7. A system as claimed in claim 1, wherein the first coupling element is adapted to couple at least one of the first wall-covering elements to one of the mounting assemblies.

8. A system as claimed in claim 7, wherein the first coupling element is adapted to couple two adjacent first wall-covering elements to one of the mounting assemblies.

9. A system as claimed in claim 1, also comprising one or more second coupling elements adapted to mutually couple the longitudinal sides of adjacent first wall-covering elements.

10. A system as claimed in claim 9, wherein each second coupling element comprises:

a number of third engaging members which can be placed into engagement with one of the first wall-covering elements on a longitudinal side thereof; and a number of third engaging members which can be placed into engagement with another of the first wall-covering elements on a longitudinal side thereof, wherein a third engaging member and a first wall-covering element both comprise a number of engaging surfaces, these engaging surfaces being embodied such that the first wall-covering element and the third engaging member can be placed into form-fitting engagement with each other such that a displacement of the first wall-covering element relative to the third engaging member in a direction substantially transversely of the longitudinal direction of the first wall-covering element is prevented.

11. A system as claimed in at least claim 10, wherein the third engaging members comprise a number of snap fingers with an engaging surface on a free end thereof, wherein the third engaging member and the first wall-covering element to be placed into engagement therewith are embodied such that by bending the snap fingers outward the engaging surface on the free end thereof can be displaced such that the engaging member can be moved in a direction transversely of the longitudinal direction of the first wall-covering element into an engaged state with the first wall-covering element in which the engaging surface on the free end of the snap fingers is in engagement with an engaging surface of the first wall-covering element, and that by bending the snap fingers outward the engaging surface on the free end thereof can be displaced such that the third engaging member can be moved in a direction transversely of the longitudinal direction of the first wall-covering element out of an engaged state with the first wall-covering element.

12. A system as claimed in at least claim 10, wherein the second engaging members comprise a number of spring elements, wherein a single spring element comprises a tubular body; and the second wall-covering elements to be placed into engagement with the second engaging members with spring elements comprise a tubular cavity, wherein a wall of the cavity comprises an opening extending in the lengthwise direction so that the tubular body of the spring elements can be placed in the cavity in order to place the engaging members in the engaged state with the second wall-covering elements;

wherein in the engaged state the outer surface of the wall of the tubular body is in contact with the inner surface of the cavity so that the spring elements are in form-fitting engagement with the second wall-covering elements.

13. A system as claimed in claim 12, wherein the third engaging members comprise a plurality of spring elements, wherein a single spring element comprises a tubular body; and the first wall-covering elements to be placed into engagement with the third engaging members with spring elements comprise a tubular cavity, wherein a wall of the cavity comprises an opening extending in the lengthwise direction so that the tubular body of the spring elements can be placed in the cavity in order to place the engaging members in the engaged state with the first wall-covering elements; and wherein in the engaged state the outer surface of the wall of the tubular body is in contact with the inner surface of the cavity so that the spring elements are in form-fitting engagement with the first wall-covering elements.

14. A system as claimed in claim 1, wherein at least one of the first wall-covering element and the second wall-covering element, preferably both the first wall-covering element and the second wall-covering element, comprises:

an upper wall with an upper surface which, when the wall-covering element has been arranged on a surface of a wall for covering, faces away from the surface of the wall for covering, and a lower surface;

two first side walls extending on both longitudinal sides of the upper wall from the lower surface and substantially transversely of the upper surface; and two lower walls extending on the longitudinal sides of the first side walls remote from the upper wall, substantially transversely of the side walls and in the same plane.

15. A system as in claim 14, wherein at least one of:

the ends of the lower walls remote from the first side walls are directed toward each other; and two side walls extending on the longitudinal sides of the lower walls remote from the first side walls substantially transversely of the lower walls in parallel planes in the direction of the lower surface of the upper wall, wherein the ends of the second side walls remote from the lower walls are situated at a distance from the lower surface of the upper wall.

16. A system as claimed in claim 1, wherein the coupling elements comprise a spacer element adapted to hold at a distance from each other two wall-covering elements mutually coupled by means of the coupling element.

17. A system as claimed in claim 1, wherein each connecting assembly comprises:

a number of first connecting members for placing the connecting assembly into engagement with the surface of the wall for covering; and a number of second connecting members for placing the connecting assembly into releasable engagement with the second wall-covering element;

wherein the first connecting members are preferably plate-like and adapted for placing thereof into non-releasable engagement with the surface of the wall for covering by means of an adhesive; and wherein the second connecting members preferably comprise a bolt and a nut co-acting therewith, and a number of holes are arranged in a second wall-covering element through which at least one of the bolt and the nut can protrude for the purpose of placing the second wall-covering element into releasable engagement with the connecting assembly.

18. A wall-covering element for forming the system as claimed in claim 1.

19. A wall-covering element as claimed in claim 18, comprising:

an upper wall with an upper surface which, when the wall-covering element has been arranged on a surface of a wall for covering, faces away from the surface of the wall for covering, and a lower surface;

two first side walls extending on both longitudinal sides of the upper wall from the lower surface and substantially transversely of the upper surface; and two lower walls extending on the longitudinal sides of the first side walls remote from the upper wall and substantially transversely of the side walls and in the same plane.

20. A wall-covering element as claimed in claim 19, wherein the core layer comprises at least the upper wall, the first side walls and the lower walls.

21. A wall-covering element as claimed in claim 19, wherein at least one of:

the ends of the lower walls remote from the first side walls are directed toward each other; and two second side walls extending on the longitudinal sides of the lower walls remote from the first side walls substantially transversely of the lower walls in parallel planes in the direction of the lower surface of the upper wall, wherein the ends of the second side walls remote from the lower walls are situated a distance from the lower surface of the upper wall.

22. A wall-covering element as claimed in claim 18, comprising a tubular cavity, wherein a wall of the cavity comprises an opening extending in the lengthwise direction.

23. A wall-covering element as claimed in claim 18, comprising:

a core layer with an upper surface and a number of side surfaces, and a cover layer covering the upper surface and at least one side surface of the core layer.

24. A wall-covering element as claimed in claim 23, wherein the core layer is hollow.

25. A wall covering formed by means of the system as claimed in claim 1.

26. A method for replacing a first wall-covering element of a wall-covering as claimed in claim 25 arranged on a surface of a wall for covering, comprising the steps of:

releasing the second wall-covering elements of the mounting assembly from the surface of the wall for covering; and uncoupling a first wall-covering element to be replaced from the mounting assemblies;

coupling a replacement first wall-covering element to the mounting assemblies by means of a number of the first coupling elements;

connecting the second wall-covering elements releasably to the surface of the wall for covering.

27. A wall covering as in claim 25, wherein at least one of:

(a) the first wall-covering elements and the second wall-covering elements are elongate elements; and the first wall-covering elements and the mounting assemblies are coupled by means of the first coupling elements such that the second wall elements each extend on a transverse side of the first wall-covering elements so that the longitudinal direction of the first wall-covering elements is oriented transversely of the longitudinal direction of the second wall-covering elements; and (b) a number of first engaging members which are in engagement with one of the first wall-covering elements on a transverse side thereof; and a number of second engaging members which are in engagement with one of the second wall-covering elements on a longitudinal side thereof;

so that the first wall-covering element is connected via the second wall-covering element to the connecting assembly of the mounting assembly.

28. A method for covering a surface of a wall using the system as claimed in claim 1, comprising the steps of:

(a) coupling the plurality of first wall-covering elements to two mounting assemblies by means of in each case at least one first coupling element, wherein each mounting assembly comprises the second wall-covering element and the connecting assembly;

(b) releasably connecting the mounting assemblies and the first wall-covering elements coupled thereto to the surface of the wall for covering by means of the connecting assemblies.

29. A method as claimed in claim 28, wherein the first and second wall-covering elements are elongate; and wherein step (a) comprises of:

coupling each of the transverse sides of the first wall-covering elements to in each case a longitudinal side of one of the second wall-covering elements; and wherein step (b) comprises of:

releasably connecting the second wall-covering elements by means of the connecting assemblies to the surface of the wall for covering.

30. A method as claimed in claim 29, also comprising the step of coupling the longitudinal sides of adjacent first wall-covering elements by means of a number of second coupling elements.

31. A method as claimed in claim 28, wherein a single connecting assembly comprises:

a number of first connecting members for placing the connecting assembly into engagement with the surface of the wall for covering; and a number of second connecting members for placing the connecting assembly into releasable engagement with a second wall-covering element; and wherein the method also comprises the step of:

(c) placing the first connecting members into non-releasable engagement with the surface of the wall for covering; and (d) placing the second wall-covering elements into releasable engagement with the first connecting members by means of the second connecting members.

32. A system as claimed in claim 1, wherein said system is present on a ship.

33. A system as claimed in claim 1, wherein the second engaging members comprise a plurality of snap fingers with an engaging surface on a free end thereof;

the second wall-covering elements to be placed into engagement with the second engaging members comprising the snap finger comprise a cavity, wherein a wall of the cavity comprises an opening extending in the lengthwise direction so that the snap fingers can be placed in the cavity in order to place the second engaging members in the engaged state with the second wall-covering elements; and in the engaged state the engaging surface of the snap finger is in contact with an engaging surface on the inner surface of the cavity so that the snap finger is in form-fitting engagement with the second wall-covering elements.

* * * * *